US007337813B2

(12) United States Patent
Koike

(10) Patent No.: US 7,337,813 B2
(45) Date of Patent: Mar. 4, 2008

(54) VENEER LATHE AND METHOD OF CUTTING WOOD BLOCK BY THE VENEER LATHE

(75) Inventor: Masaru Koike, Aichi (JP)

(73) Assignee: Meinan Machinery Works, Inc., Obu-shi (JP)

( * ) Notice: Subject to any disclaimer, the term of this patent is extended or adjusted under 35 U.S.C. 154(b) by 0 days.

(21) Appl. No.: 11/633,582

(22) Filed: Dec. 5, 2006

(65) Prior Publication Data

US 2007/0074787 A1 Apr. 5, 2007

Related U.S. Application Data

(62) Division of application No. 11/014,773, filed on Dec. 20, 2004, now Pat. No. 7,225,843.

(30) Foreign Application Priority Data

Dec. 24, 2003 (JP) ..... P2003-426729

(51) Int. Cl.
*B27D 1/04* (2006.01)
*B27G 1/00* (2006.01)
*B27G 11/00* (2006.01)

(52) U.S. Cl. ..... 144/332; 144/362; 144/209.1; 144/211; 144/213

(58) Field of Classification Search ..... 144/209.1, 144/211, 212, 215, 215.4, 332, 362, 365, 144/213
See application file for complete search history.

(56) References Cited

U.S. PATENT DOCUMENTS 4,219,060 A 8/1980 Hasegawa
4,221,247 A * 9/1980 Katsuji ..... 144/211
4,263,948 A 4/1981 Hasegawa
6,357,496 B1 * 3/2002 Koike ..... 144/213

FOREIGN PATENT DOCUMENTS

EP 1 075 913 2/2001

OTHER PUBLICATIONS

Patent Abstracts of Japan, vol. 2002, No. 06, Jun. 4, 2002 & JP 2002 046109 A, Feb. 12, 2002 abstract; figures.

* cited by examiner

*Primary Examiner*—Bena Miller
(74) *Attorney, Agent, or Firm*—Kratz, Quintos & Hanson, LLP

(57) ABSTRACT

A method of cutting a wood block for production of veneer by a rotary veneer lathe. The veneer lathe includes a veneer knife, a number of rotatable peripheral drive wheels placed parallel to the veneer knife and each having a number of tooth-like projections pierceable into a wood block for driving the wood block for rotation about its axis, and a guide member for guiding veneer peeled from the wood block. The cutting of the wood block is done at a first position of the peripheral drive wheels where the veneer peeled from the wood block is pierced by the projections to such an extent that substantial splits are formed in the veneer along wood grain thereof, and also at a second position where the projections provide no force to the veneer moving past the guide member that causes the substantial splits in the veneer.

3 Claims, 19 Drawing Sheets

VENEER LATHE AND METHOD OF CUTTING WOOD BLOCK BY THE VENEER LATHE

This application is a divisional application of Ser. No. 11/014,773, filed Dec. 20, 2004, now U.S. Pat. No. 7,225, 843 which is based on Japanese Application No. 2003-426729 filed Dec. 24, 2003.

BACKGROUND OF THE INVENTION

The present invention relates to a rotary veneer lathe for cutting a wood block to peel therefrom veneer for use in manufacturing glued laminated wood such as plywood, laminated veneer lumber (LVL), etc. The invention relates also to a method of cutting a wood block by such veneer lathe.

A conventional rotary veneer lathe, part of which is shown in FIGS. 18 and 19, is disclosed in, e.g., KOKAI publication or unexamined Japanese patent application publication No. 2002-46109. The veneer lathe shown in the drawings has an elongated veneer knife 101 mounted in a movable carriage (not shown) for peeling veneer V from a rotating wood block 115. Reference numeral 108 designates a peripheral drive system which is also mounted in the knife carriage and includes a shaft 107 extending in parallel to the knife 101 and driven to rotate by a motor (not shown). A number of spiked peripheral drive wheels 105 (only one wheel being shown in the drawings), each having on the circumferential periphery thereof a number of spikes or tooth-like projections 103, is fixedly mounted on the shaft 107 at a predetermined spaced interval in the axial direction of the shaft 107. The shaft 107 is driven by the motor to rotate the peripheral drive wheels 105 in arrow direction as shown in FIGS. 18 and 19 for driving the wood block 115 from its periphery.

The veneer lathe further has a number of pressure members 109 which is mounted in the knife carriage, each disposed between any two adjacent peripheral drive wheels 105. The pressure member 109 has at the distal end thereof a replaceable insert 9*a* for pressing against the peripheral surface of wood block 115 immediately upstream of the cutting edge of the knife 101 as seen in the direction in which the wood block 115 is rotated as indicated by arrow. A guide member 111 is also mounted in the knife carriage between any two adjacent drive wheels 105 for guiding peeled veneer V along the periphery of the spiked drive wheels 105. Immediately downstream of the guide member 111 is disposed a separating member 113 having a contact surface 113*a* extending so as to intersect an imaginary circle which passes the tip ends of the respective projections 103 of the peripheral drive wheel 105 for separating or disengaging veneer V from the projections 103 of the drive wheels 105.

Referring to FIG. 18, the spiked peripheral drive wheels 105 of the conventional rotary veneer lathe are set in the knife carriage with respect to the knife 101 such that the tip ends of those projections 103 which pierce deepest into the wood block 3 are spaced at a distance of, e.g., about 1.5 mm from an imaginary line X-X (FIG. 18) which is drawn vertically upward from the cutting edge of the knife 5 and is assumed as an approximate line along which the knife 101 would cut into the wood block 115 when the latter is rotated in arrow direction.

In operation of the veneer lathe, with the wood block 115 supported at the opposite axial ends thereof by spindles (not shown) being driven to rotate in arrow direction by the spindles or the spiked peripheral drive wheels 105, the knife carriage is moved to feed the knife 101 into the wood block 115 at a controlled feedrate thereby to peel by the veneer knife 101 a veneer strip or sheet V with a predetermined thickness from the rotating wood block 115.

It is well known to those skilled in the art that a veneer lathe having the peripheral drive system 108 as shown in FIG. 18 is advantageous in that an excessive force will not be applied to wood block, so that a block having a weak core portion can be cut smoothly down to a small core diameter. To be more specific, the above veneer lathe is so designed and arranged that the power for driving the spindles thereby to rotate wood block 115 for peeling veneer therefrom is only of such a magnitude that veneer with a small thickness of about 1.5 mm is peelable, but it is insufficient for peeling veneer whose thickness is larger than 1.5 mm and, therefore, the power which is necessary for cutting wood block 115 for peeling veneer therefrom is supplied to the block primarily by the spiked drive wheels 105 which are disposed on the periphery of wood block 115 as shown in FIG. 18.

In cutting a wood block for producing veneer with a thickness of, e.g., about 3 mm, the peripheral drive wheels 105 in rotation is engaged at the tooth-like projections 103 thereof with the peripheral surface of the wood block 115, as shown in FIG. 18, thus power for cutting veneer from the block 115 being supplied to the block 115 from the peripheral drive wheels 105. Therefore, a wood block which is supported at its weak core portion by spindles can be cut successfully down to a small core diameter without being broken in the middle of peeling.

It is noted that, when the peripheral drive wheels 105 rotate in arrow direction, the wood block 115 is not rotated instantly with the rotation of the drive wheels 105 because of the cutting resistance exerted by the veneer knife 101 cut into the wood block 115. The force of the peripheral drive wheels 105 acting at the projections 103 thereof on the wood block 115 for rotation is increased while elastically deforming the wood of the block 115 at the projections 103 of the drive wheels 105, and the wood block 115 begins to be rotated for veneer peeling when the above force is increased to exceed the cutting resistance. Thus, the periphery of the wood block 115 is moved slower than the projections 103 of the peripheral drive wheels 105 for the above elastic deformation of the wood block 115. Consequently, the peripheral speed of the spiked drive wheels 105 at the projections 103 thereof is higher than the traveling speed of veneer V peeled from wood block 115 at the location adjacent to the guide members 111, so that the veneer V is subjected to tensile force by the projections 103 and, therefore, the veneer V just peeled from the wood block 115 is formed with a number of splits extending in the direction of wood grain of the veneer V, or in the direction that is perpendicular to the direction in which the veneer V is moved along the periphery of the spiked drive wheels 105. The veneer sheet V moving past the guide members 111 is then brought into contact with the surfaces 113*a* of the separating members 113 and bent downward as shown in FIG. 18, where further splits are formed in the veneer V.

During initial period of veneer peeling operation before the wood block becomes substantially cylindrical, veneer strips of various narrow widths are produced which are curled or coiled into spiral shape. Such curled veneer strips are troublesome to handle in the subsequent processes, but formation of splits along the wood grain of such veneer strips is effective to minimize curling of veneer strips.

Once the wood block 115 has been rounded up or become substantially cylindrical, a continuous veneer sheet V is peeled from the block 115. When a veneer sheet with a continuous width and free from pierced markings made by the projections 103 of the peripheral drive wheels 105 is needed for use as face veneer of plywood, the peripheral drive wheels 105 are moved for retraction by any suitable actuator as indicated by oblique arrow in FIG. 18 to a position shown in FIG. 19 where the projections 103 engage neither with the wood block 115 nor the veneer sheet V.

In veneer peeling with the peripheral drive wheels 105 positioned as shown in FIG. 18, splits formed in the veneer V by the tensile force from the projections 103 when the veneer V moves past the guide members 111 may be extended or lengthened along the wood grain depending on the species of wood veneer. Such veneer is weak to tensile force and hence tend to be broken easily along the extended splits, thus seriously affecting the overall veneer yield.

If veneer peeling is done with the peripheral drive wheels 105 retracted as shown in FIG. 19, splits will not be formed, but no driving force is transmitted from the peripheral drive wheels 105 to the wood block 115. Therefore, the veneer lathe then becomes incapable of peeling veneer sheet with a thickness of, e.g., about 3 mm.

When a knotty coniferous wood block is cut for veneer production, the resulting veneer has in it many knots. If a knot in the veneer may move between any two adjacent guide members 111, the knot is pressed from above by the projections 103 of a peripheral drive wheel 105 and broken to be removed from the veneer, with the result that a veneer sheet is produced which has a defective void portion and, therefore, is unusable as face veneer of plywood or similar panel product.

Therefore, it is an object of the present invention to provide a veneer lathe and a method of cutting wood block by such veneer lathe which can solve the aforementioned problems.

SUMMARY OF THE INVENTION

A method of cutting a wood block for production of veneer according to the invention is performed by a rotary veneer lathe having a knife carriage which is equipped with a peripheral drive system for rotating a wood block from its periphery. The knife carriage includes a veneer peeling knife having a cutting edge, and the peripheral drive system has a number of rotatable peripheral drive wheels which are disposed at a spaced interval in parallel relation to the cutting edge of the veneer knife and each of which has on the circumferential periphery a number of tooth-like projections pierceable into peripheral surface of the wood block adjacent to the cutting edge of the veneer knife for driving the wood block from the periphery thereof for rotation about its axis. Though the peripheral drive wheels are mounted in the knife carriage, the wheels are movable relative to the knife carriage. The veneer lathe has a support such as spindles for rotatably supporting the wood block, and the knife carriage further includes a first drive for rotating the peripheral drive wheels, a second drive for moving the peripheral drive wheels relative to the knife carriage, a pressure member disposed adjacent to the peripheral drive wheel for pressing against the peripheral surface of the wood block, a guide member disposed adjacent to the peripheral drive wheel for guiding veneer peeled from the wood block along the peripheral drive wheels, and a separating member disposed downstream of the guide member with respect to the direction of rotation of the peripheral drive wheels for separating the veneer from the peripheral drive wheels. According to a preferred embodiment of the invention, the knife carriage is movable toward the wood block such that the veneer knife on the knife carriage cuts into the peripheral surface of rotating wood block for peeling veneer therefrom.

In a preferred embodiment of the wood block cutting method according to the invention, cutting of the wood block is done with the peripheral drive wheels placed at a first position thereof where the projections of the peripheral drive wheels pierce the peripheral surface of the wood block adjacent to the cutting edge of the veneer knife and the veneer just peeled from the wood block and then moving past the guide member is pierced by the projections to such an extent that substantial splits are formed in the veneer along the wood grain thereof by a force of the projections acting on the veneer, and cutting of the wood block is done also with the peripheral drive wheels placed at a second position thereof where the peripheral surface of the wood block is pierced in the same manner as in the first position, but the projections of the peripheral drive wheels provide no such force to the veneer peeled from the wood block and moving past the guide member that causes the substantial splits in the veneer. In the preferred embodiment, the peripheral drive wheels are movable toward the rotating block from the second position.

In the preferred embodiment, cutting of wood block at the first position of the peripheral drive wheels is done while veneer strips with irregular or varying widths are being peeled from the block and the peripheral drive wheels are moved to their second position after a continuous sheet of veneer begins to be cut from the block. The peripheral drive wheels begins to move at a controlled rate toward the rotating block from the second position when the wood block diameter is reduced to a predetermined value.

In another preferred embodiment, after the peripheral drive wheels are moved from the first position to the second position, they are moved back to the first position when the wood block diameter is reduced to a predetermined value. In still another embodiment, the peripheral drive wheels after moving back to the first position are moved therefrom toward the rotating block.

The present invention also provides a rotary veneer lathe for practicing the method of cutting wood block for production of veneer.

Thus, the peripheral drive wheels are movable relative to the knife carriage in various ways depending on the conditions of wood blocks to be peeled and other requirements, as will be explained more in detail in the description of the preferred embodiments of the invention, which description is made with reference to the accompanying drawings, wherein:

DETAILED DESCRIPTION OF THE EMBODIMENTS

The following will describe a first preferred embodiment of the present invention with reference to FIGS. 1 through 11.

Figure 1:
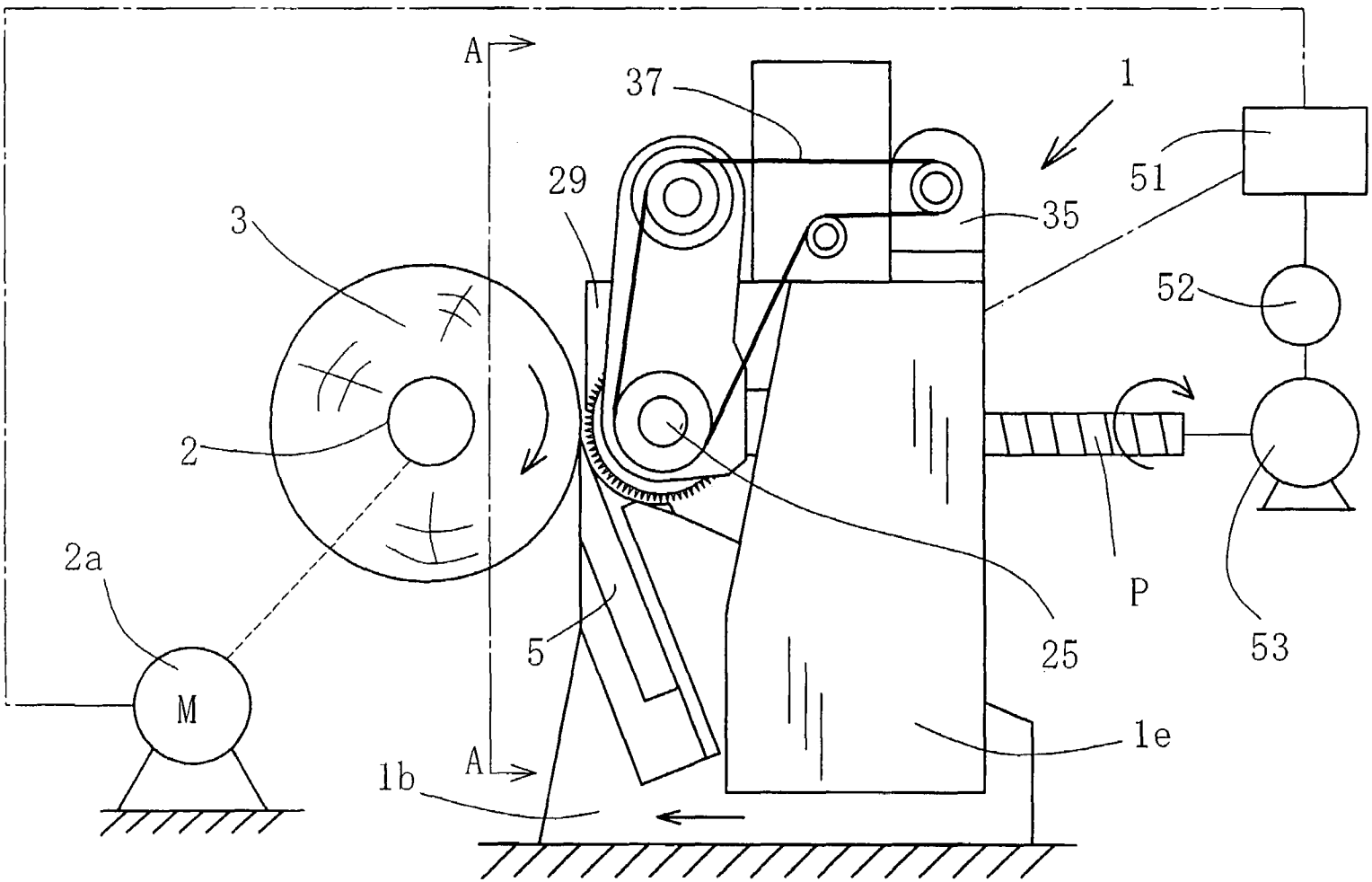
FIG. 1 is a schematic side view showing a veneer lathe of the present invention and illustrating a method of cutting wood block by the veneer lathe according to the present invention.

Referring firstly to FIG. 1, the rotary veneer lathe has a movable knife carriage 1 having mounted therein a veneer peeling knife 5 for cutting a wood block 3 for peeling veneer therefrom. The wood block 3 is supported at the opposite axial ends thereof by spindles 2 (only one spindle being shown) which are driven to rotate in arrow direction by a servo motor 2*a* which is connected to a control unit 51. The veneer lathe has a pair of screws P (only one screw being shown in the drawing) which are inserted through and engaged with internally threaded holes (not shown) formed in suitable blocks fixed to the knife carriage 1 so that rotation of the screws P causes the knife carriage 1 to move relative to the wood block 3. The screws P are driven to rotate by a servo motor 53 so as to move the knife carriage 1 toward and hence the veneer knife 5 into a rotating wood block 3 at a controlled feedrate for peeling veneer from the block 3. The servo motor 53 is connected to the control unit 51 through an absolute encoder 52. As is well known in the art, for veneer peeled by the knife 5 to have a predetermined thickness, the servo motor 53 is operable to drive the screws P in such a way that the veneer knife 5 is moved to cut into the wood block 3 for a distance corresponding to the desired thickness of veneer to be peeled for each complete turn of the wood block 3. It is note that power of the servo motor 2*a* for driving the spindles 2 is not great enough to overcome by itself the cutting resistance encountered when peeling veneer from the wood block 3.

Figure 2:
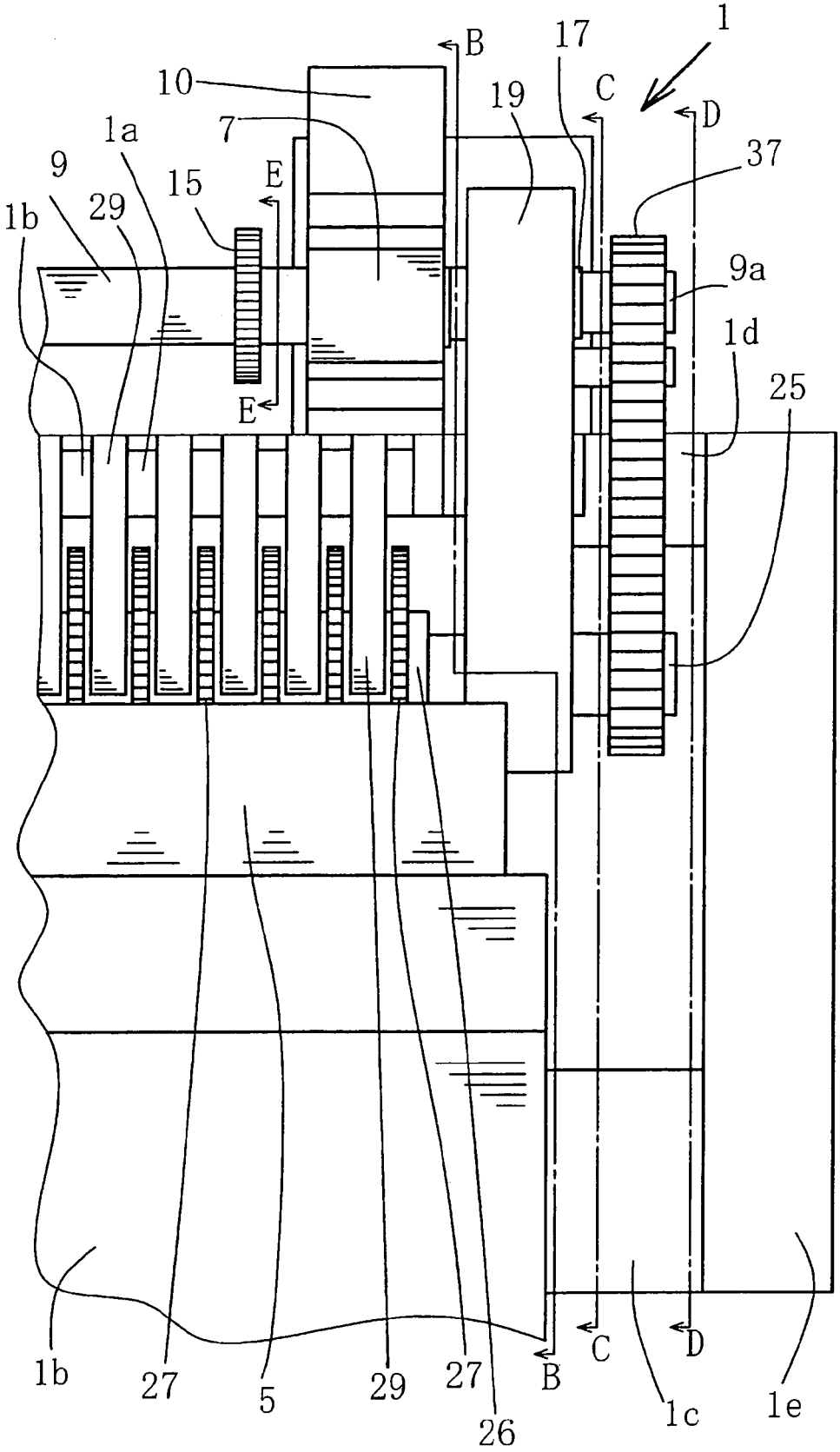
FIG. 2 is an enlarged partial front view as seen from A-A of FIG. 1 with a wood block removed for clarity.
Figure 3:
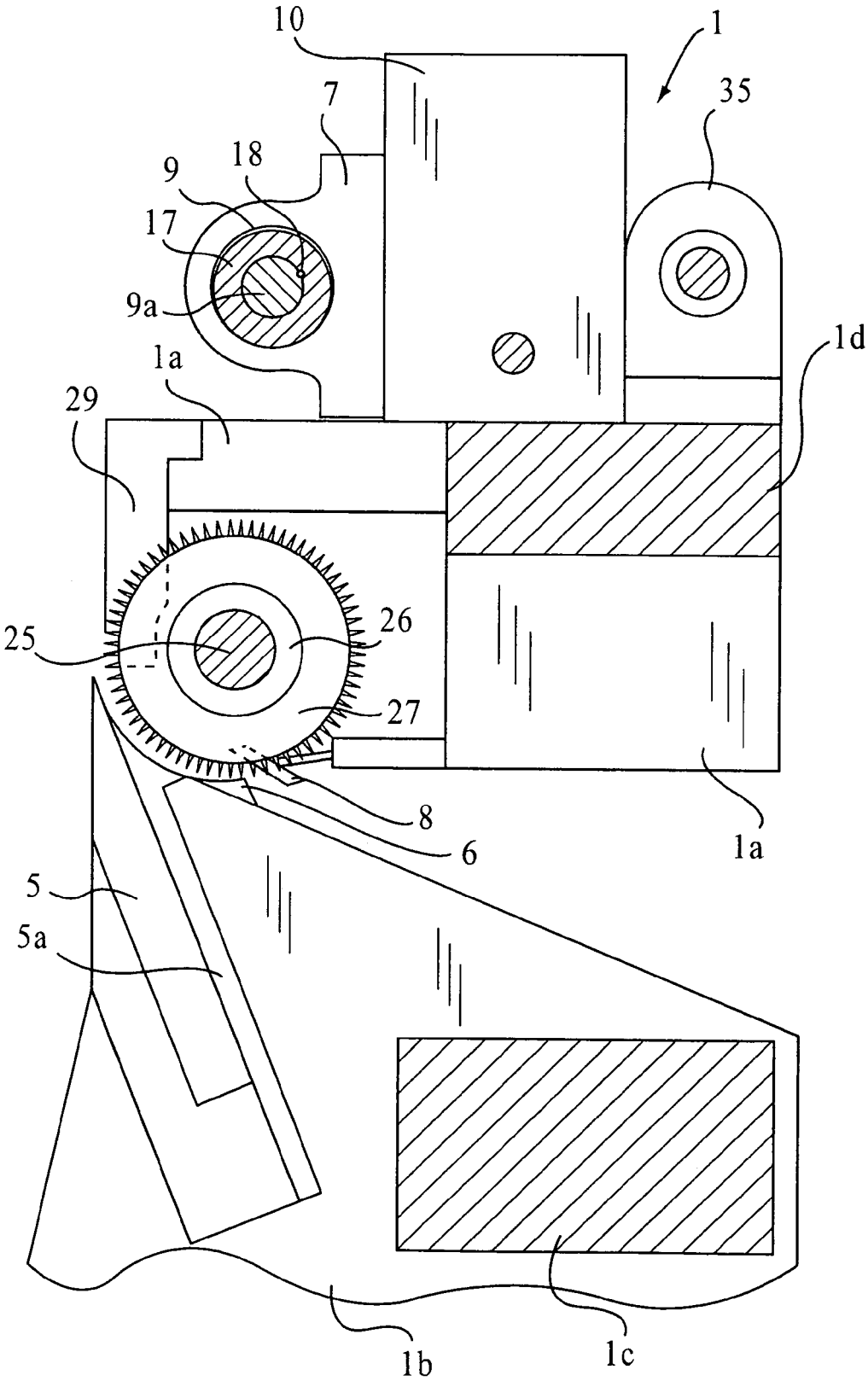
FIG. 3 is a partially sectional side view as seen from B-B of FIG. 2.
Figure 6:
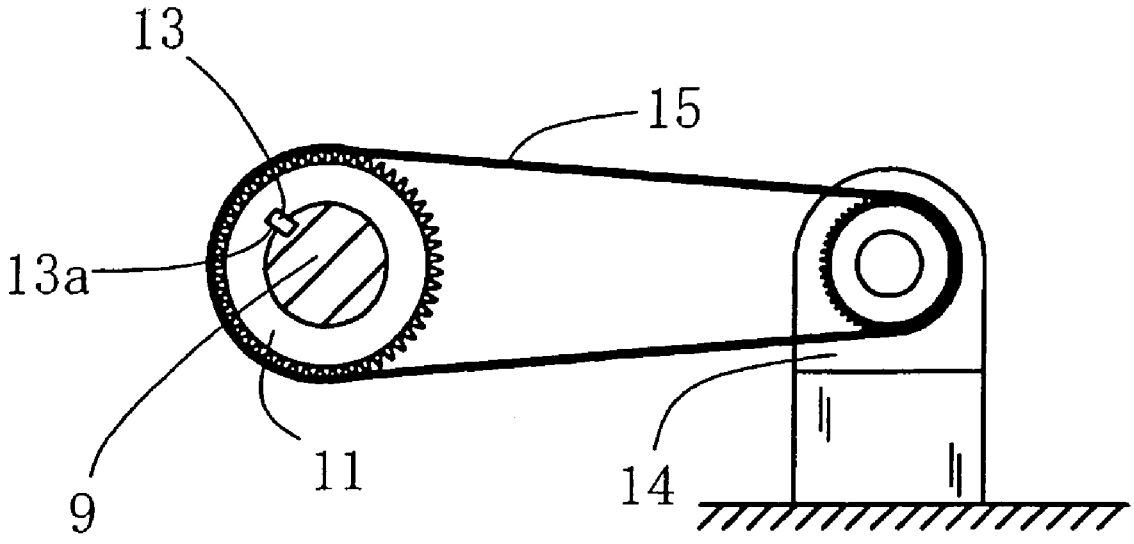
FIG. 6 is a partially sectional side view as seen from E-E of FIG. 2.

Referring to FIGS. 2 and 3, the knife carriage 1 has a first shaft 9 which is rotatably supported at the opposite ends thereof by a pair of pillow block bearing units 7 (only one unit being shown) which are fixedly mounted to mounting blocks 10 provided on opposite sides of the knife carriage 1. As shown in FIG. 6, a sprocket wheel 11 is fixed on the first shaft 9 by means of a key 13 inserted in key holes 13*a* and connected by a chain 15 to a servo motor 14 having a tachogenerator (not shown) which is operable to count the angle of rotation of the motor 14. Though not shown in the drawing, the servo motor 14 is connected to the control unit 51 so that the first shaft 9 is controllably rotated by the servo motor 14 over a desired angle.

The first shaft 9 has at one end thereof a reduced or small-diameter portion 9*a* which is formed integral and coaxial with the first shaft 9. A second shaft 17 in the form of a tube is keyed at 18 on the small-diameter portion 9*a* of the first shaft 9 for rotation therewith. Specifically, the outer diameter of the second shaft 17 is smaller than that of the first shaft 9 by about 3 mm and the second shaft 17 is fixed in an eccentric relation to the first shaft 9 with the axis of the second shaft 17 displaced from the axis of rotation of the first shaft 9 by about 3 mm, as shown in FIG. 3, so that, as the first shaft 9 is rotated over an angle of 180°, the second eccentric shaft 17 is rotated therewith to a position as shown in FIG. 9 where the second eccentric shaft 17 is lifted about 3 mm from the position of FIG. 3.

Figure 4:
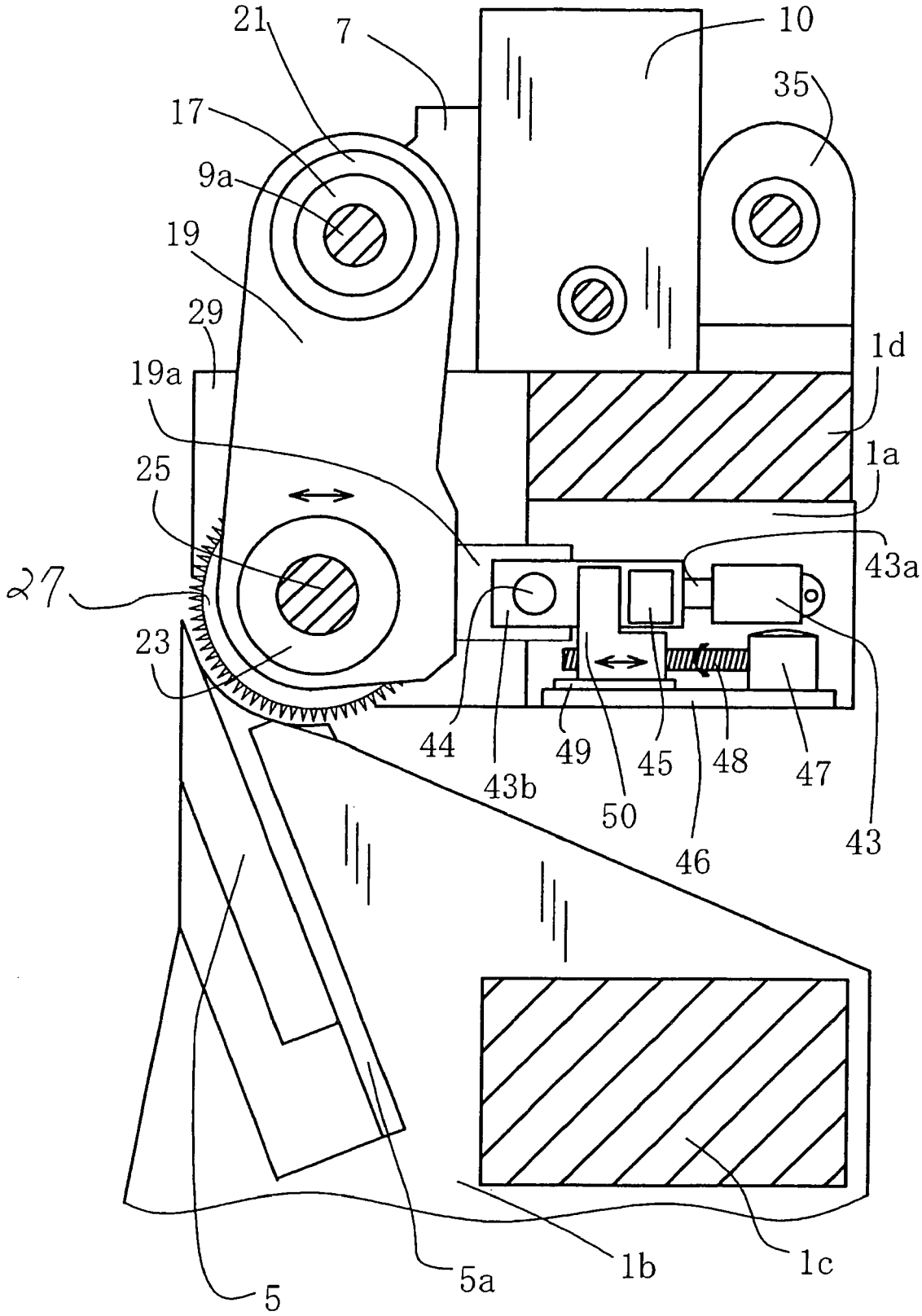
FIG. 4 is a partially sectional side view as seen from C-C of FIG. 2.

Referring to FIGS. 2 and 4, an arm 19 is provided in the knife carriage 1, whose upper end is supported by the second eccentric shaft 17 by way of a first bearing 21 so that the arm 19 is freely swingable about the shaft 17. As shown in FIG. 2, there is provided a third shaft 26 extending in parallel to the first shaft 9 and having a coaxial small-diameter portion 25. As shown in FIGS. 2 and 4, the third shaft 26 is rotatably supported at its small-diameter portion 25 by the lower end portion of the arm 19 by way of a second bearing 23. A number of spiked peripheral drive wheels 27 each having on the circumferential periphery thereof a number of spikes or sharp-pointed tooth-like projections 27*a* is fixed or keyed on the shaft 26 at a predetermined spaced interval in the axial direction of the shaft 26.

Figure 9:
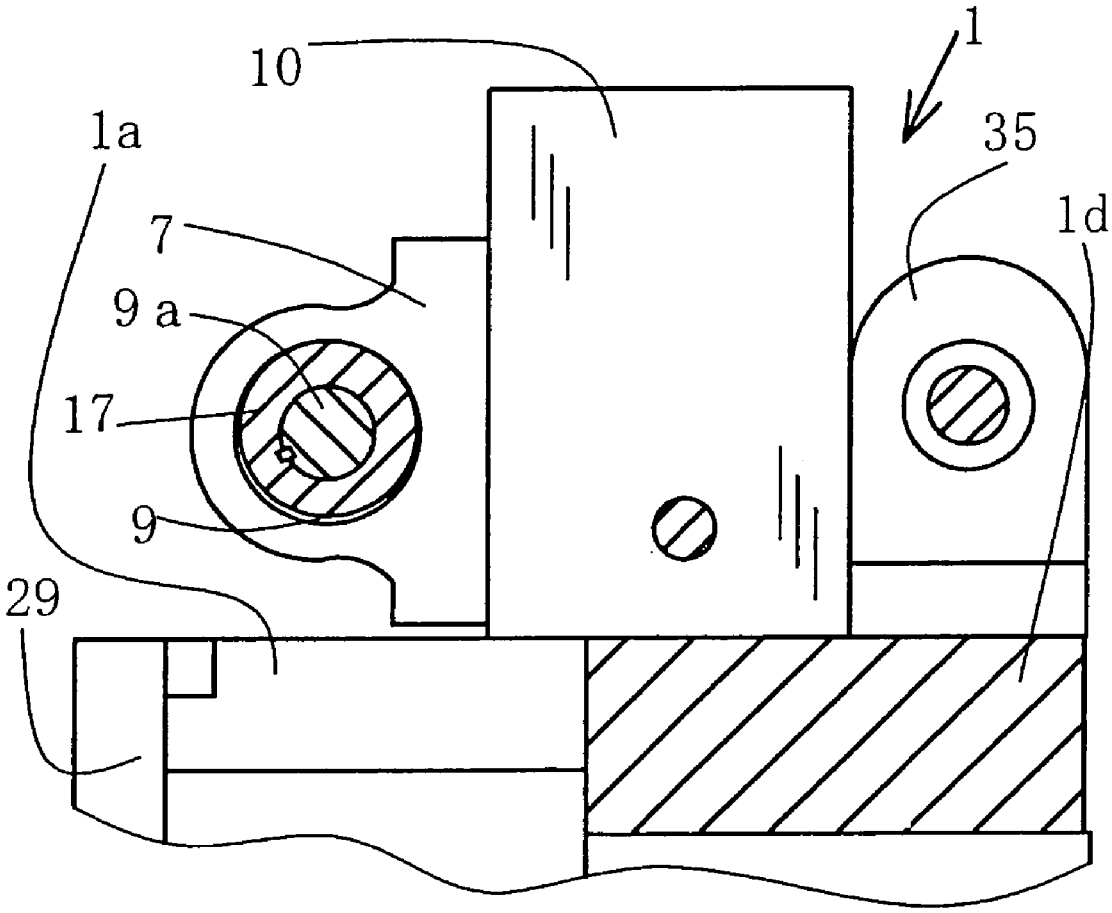
FIG. 9 is an enlarged side view showing a part of the lathe.

In the above-described arrangement, as the first shaft 9 is rotated by the servo motor 14 to place the second eccentric shaft 17 as shown in FIG. 3 where the uppermost peripheral part of the eccentric shaft 17 is positioned lowest, the peripheral drive wheels 27 are moved to their lowest position, and as the first shaft 9 is rotated for an angle of 180° by the servo motor 14 so that the eccentric shaft 17 is placed as shown in FIG. 9 where the uppermost peripheral part of the eccentric shaft 17 is positioned highest, the peripheral drive wheels 27 are moved to their highest position.

Between any two adjacent spiked peripheral drive wheels 27 on the shaft 26 is disposed a nose bar 29 serving as a pressure member which is mounted at the top portion thereof to a pressure bar block 1*a*, as shown in FIGS. 2 and 3. The nose bar 29 has fixed thereto at the lower end thereof a replaceable insert 29*a*, as shown in FIG. 7, which is pressed against the peripheral surface of the wood block 3 at a position immediately upstream of the cutting edge of the knife 5 as seen in the rotational direction of the wood block 3.

Figure 7:
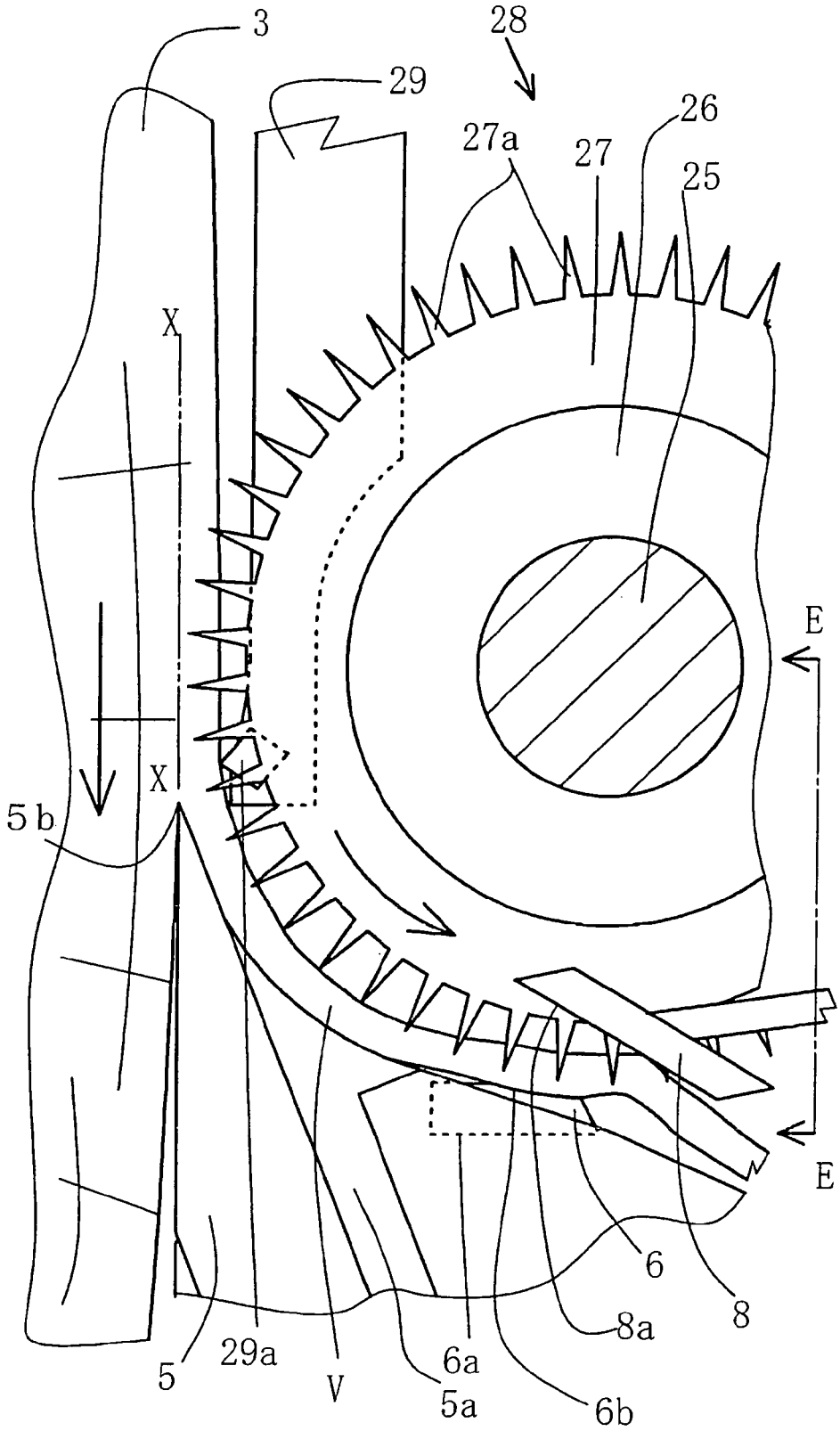
FIG. 7 is an enlarged side view showing a veneer knife engaged with a wood block for peeling veneer therefrom and other parts and devices of the veneer lathe of FIG. 1.
Figure 8:
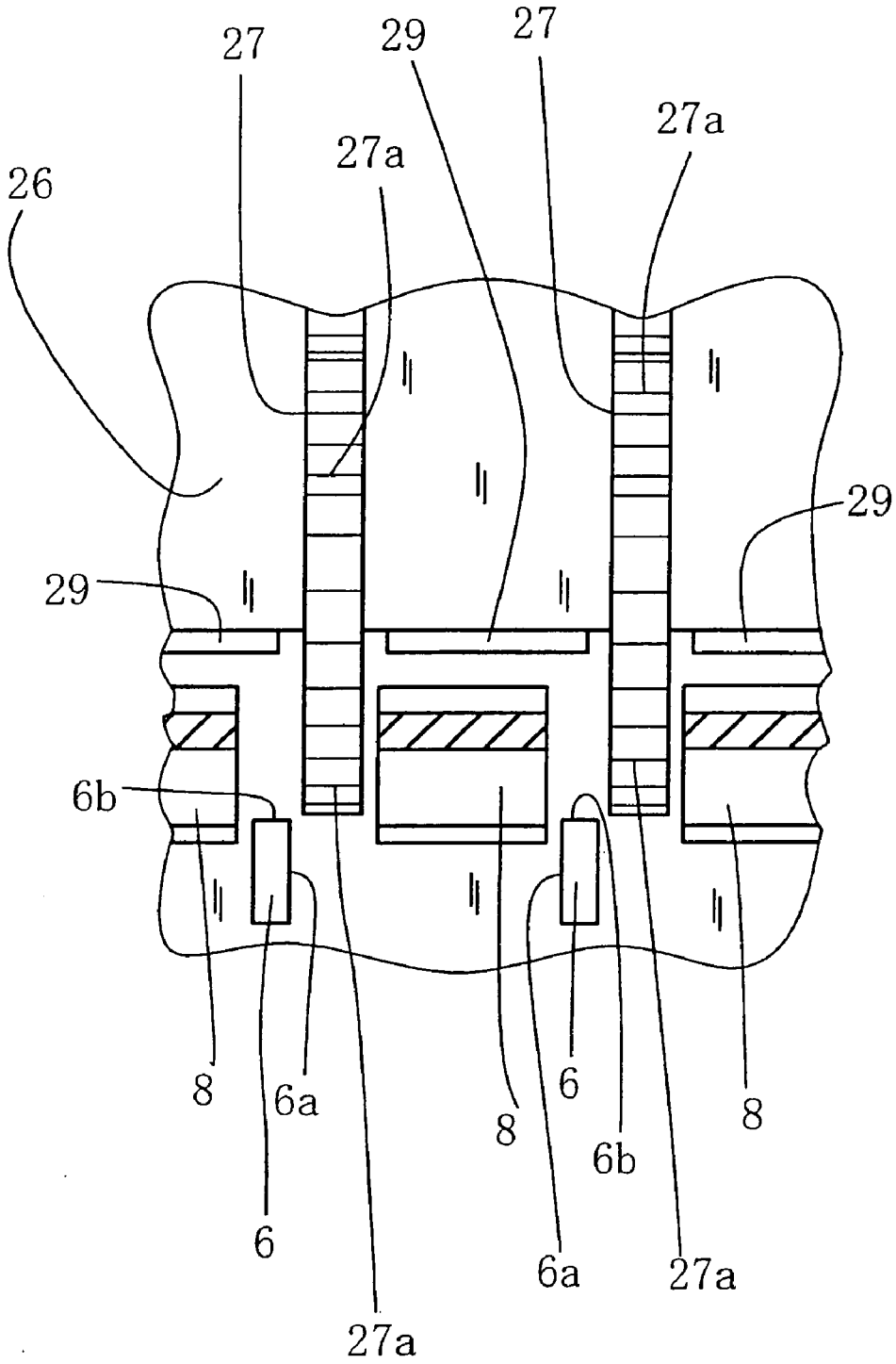
FIG. 8 is a partial front view as seen from F-F of FIG. 7.

Between any two adjacent peripheral drive wheels 27 is also disposed a separating member 8 which is mounted to the nose bar block 1*a*, as shown in FIGS. 7 and 8, and has a surface 8*a* intersecting an imaginary circle (not shown) formed by the tip ends of the respective projections 27*a* of a rotating peripheral drive wheel 27.

Figure 5:
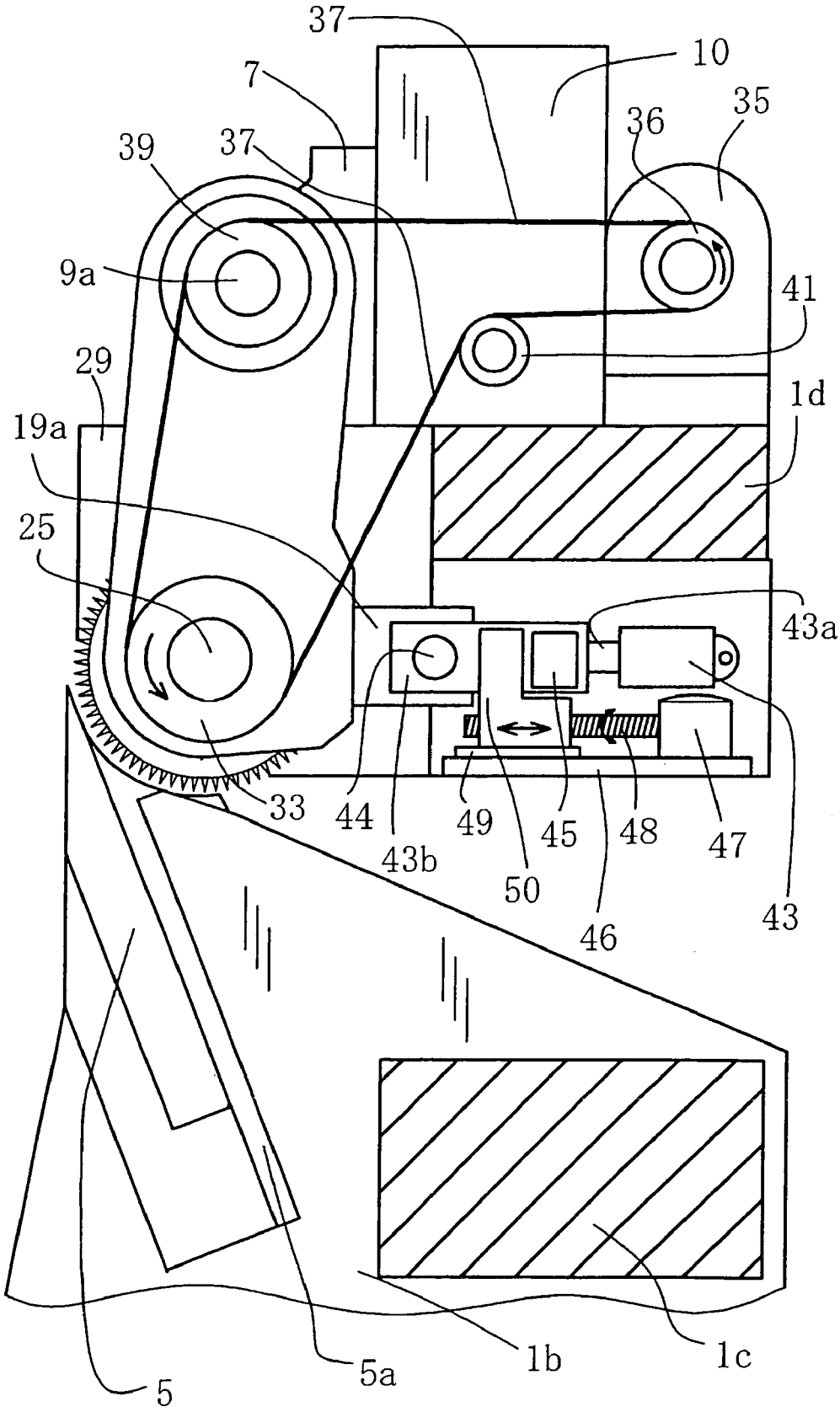
FIG. 5 is a partially sectional side view as seen from D-D of FIG. 2.

As shown in FIG. 5, a sprocket wheel 33 is fixedly mounted on one end of the shaft 25, and an endless drive chain 37 is trained between this sprocket wheel 33 and a sprocket wheel 36 fixed on output shaft of a servo motor 35 mounted on the nose bar block 1*a*, through idler sprocket wheels 39 and 41 which are mounted on the small-diameter portion 9*a* and to the mounting block 10 by way of bearings, respectively, so that power of the servo motor 35 is transmitted to the shaft 25 for driving the spiked peripheral drive wheels 27 to rotate in arrow direction. Though not shown, one-way clutch is provided between the output shaft of the servo motor 35 and the sprocket wheel 36. The servo motor 35 is connected to the control unit 51 and operation of the servo motor 35 is so controlled that the peripheral speed of the spiked drive wheels 27 at the tip ends of their projections 27*a* is slightly lower than the peripheral speed of wood block 3.

Referring again to FIG. 4, a hydraulic cylinder 43 which is rotatably mounted to the nose bar block 1*a* is operatively connected to the arm 19 by way of a first connecting plate 19*a* which is fixed, on one hand, to the lower end portion of the arm 19 on the side opposite to the veneer knife 5 and connected, on the other hand, by a pin 44 to a second connecting plate 43*b* which is in turn fixed to the distal end of a piston rod 43*a* of the hydraulic cylinder 43. An engagement member 45 is fixedly mounted to the second connecting plate 43*b*, projecting therefrom toward the reader or away from the sheet of the drawing.

A support block 46 is fixed to the nose bar block 1*a*, projecting therefrom in the same direction as the engagement member 45, and a reversible servo motor 47 is mounted on the support block 46 and connected to the control unit 51. A screw or a threaded rod 48 is operatively connected to the servo motor 47 and engaged with an internally threaded hole (not shown) formed in a stop member 50, so that rotation of the servo motor 47 and hence of the screw 48 causes the stop member 50 to move relative to the knife carriage 1 along a linear bearing 49 in either of the arrow directions (FIG. 4) depending on the direction in which the servo motor 47 is then rotated. The stop member 50 is formed with a contact surface which is engageable with the engagement member 45 on the second connecting plate 43*b*.

Thus, the arm 19 is swingable about the shaft portion 9*a* in opposite arrow directions by extension and retraction of the piston rod 43*a* of the hydraulic cylinder 43, thereby making it possible for the peripheral drive wheels 27 to move toward and away from the wood block 3.

Referring to, e.g., FIG. 3, the veneer peeling knife 5 is held securely with a gib plate 5*a* in a knife holder block 1*b* which forms the lower part of the knife carriage 1, in a manner well known in the art.

Figure 18:
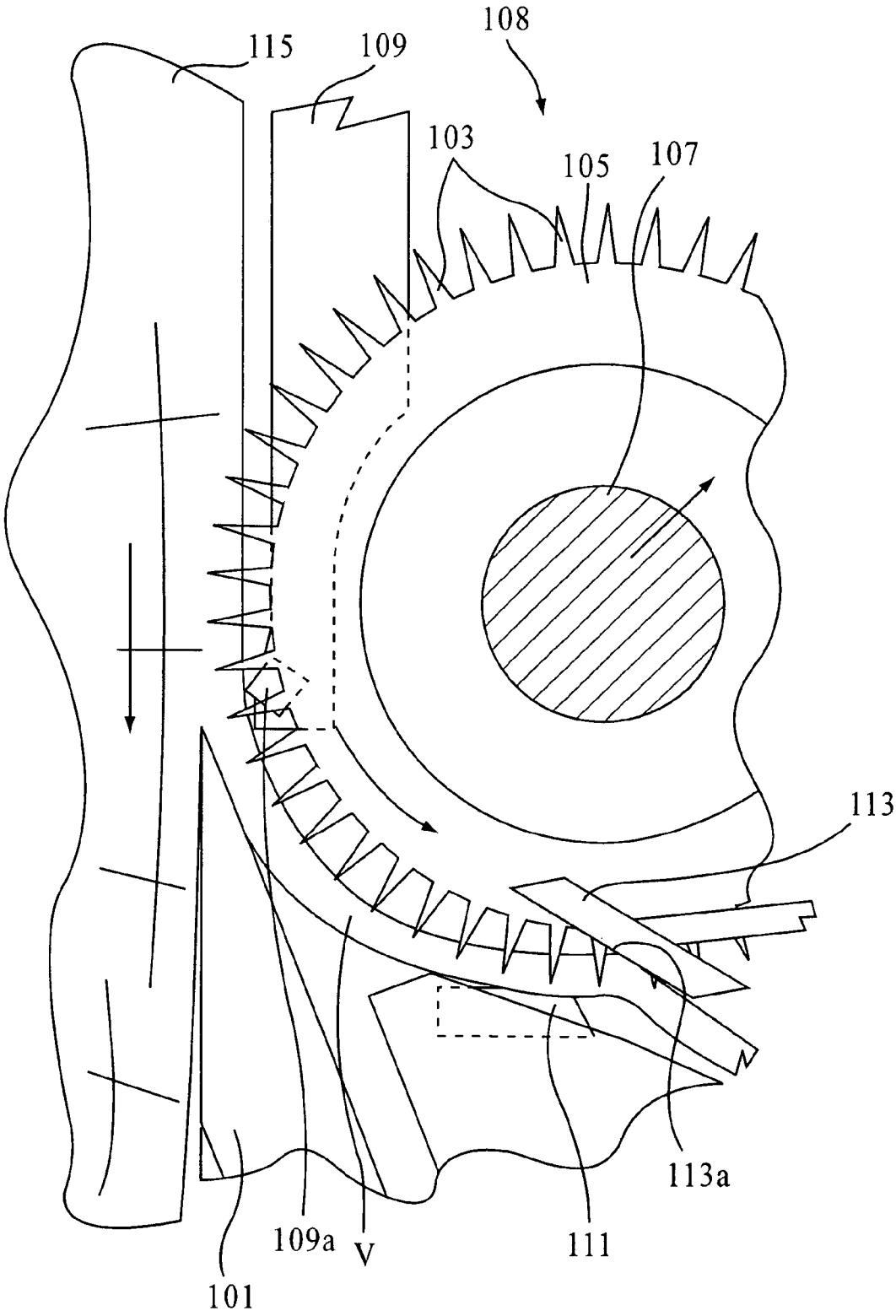
FIG.18 PRIOR ART
FIGS. 18 and 19 are illustrative enlarged partial views showing a conventional rotary veneer lathe.
Figure 19:
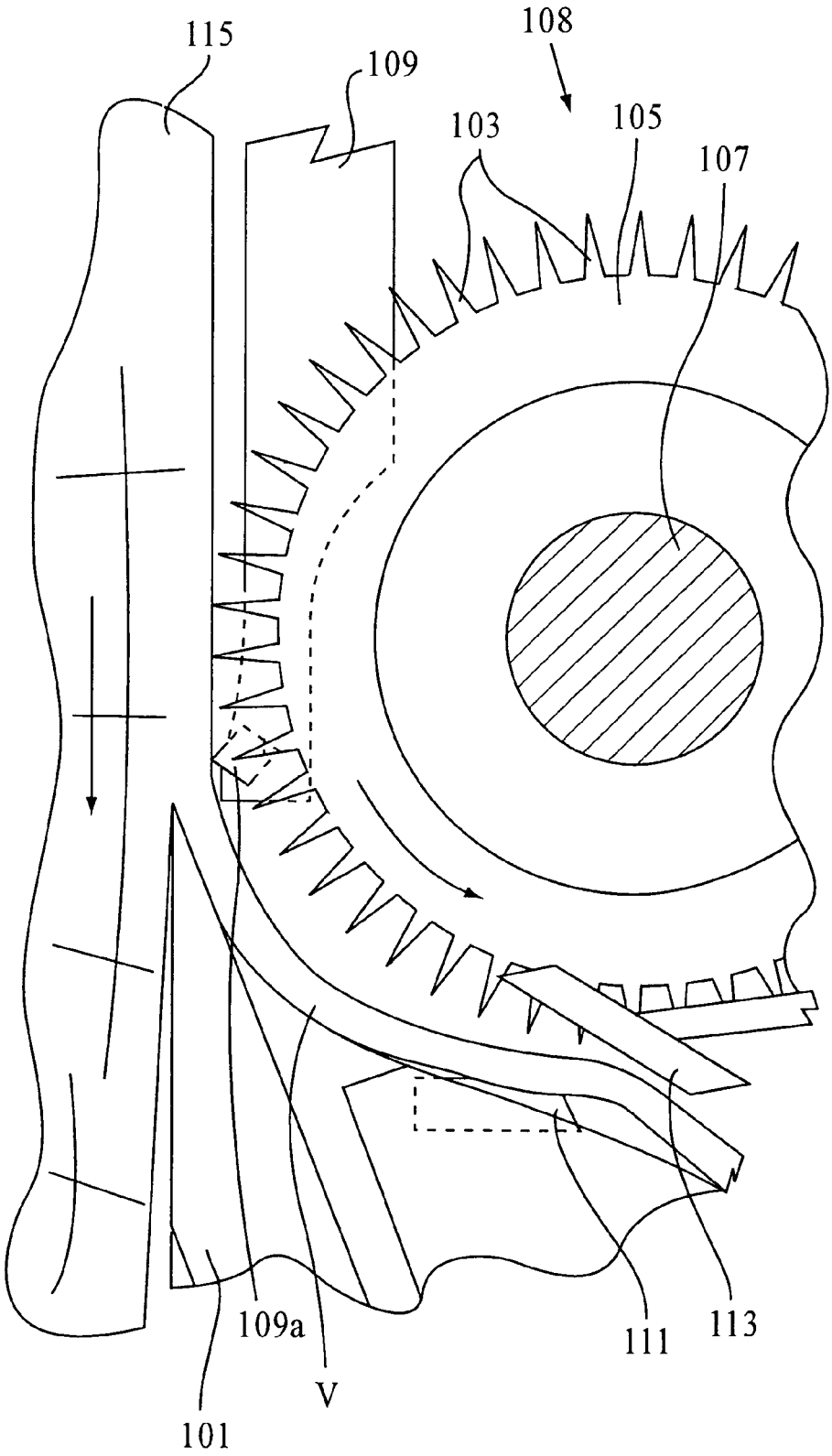
FIG.19 PRIOR ART

As shown in FIG. 7, a recess 6*a* is formed in the knife holder block 1*b* adjacent to the cutting edge 5*b* of the veneer knife 5 between any two adjacent peripheral drive wheels 27, and a guide member 6 which is similar to the guide member 111 of FIGS. 18 and 19 is fixedly inserted in the recess 6*a*. As shown clearly in FIGS. 7 and 8, the guide member 6 has a top surfaee 6*b* which is formed with a curve similar to an arc of an imaginary circle formed by the tip ends of the respective projections 27*a* of a rotating peripheral drive wheel 27. As shown in FIG. 7, the guide member 6 is disposed upstream of the separating member 8 as seen in the rotational direction of the peripheral drive wheels 27.

As shown in FIGS. 2 and 3, part 1*d* of the nose bar block 1*a* and part 1*c* of the knife holder block 1*b* are connected to a connecting member 1*e* for integrating the nose bar block 1*a* and the knife holder block 1*b*, thereby forming the knife carriage 1.

Though FIG. 2 shows part of the knife carriage 1 on the right-hand side as seen from the front of the veneer lathe, a similar and symmetrical arrangement is provided on the opposite left-hand side of the knife carriage 1. It is also noted that the control unit 51 is connected to various parts and devices of the veneer lathe, as well as to the aforementioned motors, for controlling the veneer peeling operation of the rotary veneer lathe.

In operation, the servo motor 53 responding to a control signal from the control unit 51 drives to rotate the lead screws P at such a rate that the knife carriage 1 is moved toward the wood block 3 supported by the spindles 2 for a distance corresponding to the thickness of veneer sheet to be peeled by the knife 5 for each complete turn of the wood block 3. Receiving information from the absolute encoder 52 which is indicative of the current spaced distance between the axial center of the spindles 2 and the cutting edge of the knife 5, the control unit 52 generates a control signal to drive the servo motor 2*a* such that the speed of the spindles 2 is increased in inverse proportion to the above spaced distance so that the peripheral speed of the wood block 3 at the point of cutting by the knife 5 may be substantially constant. Furthermore, the control unit 52 generates signals to control the operation of servo motors 14, 47 and other devices of the lathe in response to a signal generated from manual operation by lathe operator and also to preset signals as will be described more in detail hereinafter.

The following will describe a method of cutting a wood block for peeling veneer therefrom by way of explaining the operation of the above-described veneer lathe.

Referring to FIG. 7, a chain double-dashed line X-X which is drawn vertically upward from the cutting edge of the knife 5 is an imaginary approximate line along which the knife 5 would cut into a wood block 3 when the block 3 is rotated in arrow direction. Firstly, the spiked peripheral drive wheels 27 are set in standby position shown in FIG. 7 where, on one hand, the tip ends of those projections 27*a* which are most adjacent to the vertical line X-X are spaced at a distance of, e.g., about 1.5 mm from the line X-X and, on the other hand, the tip ends of those projections 27*a* which are adjacent to the guide members 6 are spaced from the top surface 6*b* thereof at a distance of, e.g., about 1.5 mm. This position of the peripheral drive wheels 27 is referred to as "lowered position."

For accomplishing this position of the peripheral drive wheels 27, with the hydraulic cylinder 43 set in inoperative state or no pressure acting on its piston rod 43*a*, the motor 14 (FIG. 6) is driven by manual operation to rotate the first shaft 9 to a position where the uppermost peripheral part of the second eccentric shaft 17 is positioned lowest as shown in FIG. 3 so that the peripheral drive wheels 27 mounted on the shaft 26 are moved downward. Subsequently, driving the servo motor 47 to rotate the screw 48, the stop member 50 is moved to a position where the peripheral drive wheels 27 are placed at the above-described "lowered position" when the hydraulic cylinder 43 is activated and the engagement member 45 on the plate 43*b* is brought into pressing contact with the stop member 50.

With the hydraulic cylinder 43 actually activated, the engagement member 45 is kept pressed against the stop member 50. Furthermore, the control unit 51 is set such that the knife carriage 1 is moved by operation of the servo motor 53 toward a wood block 3 for a distance of 4 mm for each complete turn of the spindles 2. The spindles 2 are operated to move toward each other thereby to hold the wood block 3 at the axial center of the opposite ends thereof.

In response to a start signal provided manually by lathe operator, the control unit 51 generates a control signal to activate the servo motor 2*a* to drive the spindles 2 thereby to rotate the wood block 3, and also to activate the servo motor 35 to rotate the peripheral drive wheels 27. Simultaneously, the servo motor 53 is also operated to controllably rotate the screws P. Thus, the knife carriage 1 is moved toward the wood block 3 at a speed or a feedrate which is determined by the control unit 51 depending on the rotational speed of the spindles 2 and the spaced distance between the axial center of the spindles 2 and the cutting edge of the veneer peeling knife 5.

In the meantime, the knife 5 and the rotating peripheral drive wheels 27 are brought into engagement with the periphery of the wood block 3 and veneer begins to be peeled from the block 3 by the knife 5, as shown in FIG. 7. The peripheral speed of the spiked drive wheels 27 at the tip ends of their projections 27*a* is then slightly lower than the peripheral speed of the wood block 3, as described earlier. Since the power of the servo motor 35 is transmitted to the peripheral drive wheels 27 by way of the one-way clutch for the servo motor 35, the drive wheels 27 gain speed by the force transmitted from the wood block 1 until the peripheral speed becomes substantially the same as that of the wood block 3. In such a state, the peripheral drive wheels 27 do not yet transmit power to the wood block 3 for positive rotation.

However, since the power of the spindle 2 is insufficient for driving the wood block 3 by itself for cutting veneer therefrom, the peripheral speed of the wood block 3 is decreased by the cutting resistance exerted by the knife 5 and, therefore, the peripheral speed of the peripheral drive wheels 27 is decreased with the slow-down of the wood block 3. When the peripheral speed of the peripheral drive wheels 27 at the tip ends of the projections 27*a* is reduced to a predetermined value, power of the peripheral drive wheels 27 is then transmitted to the block 3 because of the action of the one-way clutch and veneer with a thickness of about 4 mm is peeled by the knife 5 from the rotating wood block 3. During this initial period of peeling operation, veneer strips with various narrow widths are produced before the wood block 3 becomes substantially cylindrical by round-up peeling.

In FIG. 7, the veneer strip V is subjected to tensile force by the projections 27*a* of the drive wheels 27 when the strip moves past the guide members 6, thus the veneer strips V being formed with large or substantial splits extending along the wood grain of the veneer.

Additionally, the splits are enlarged and also new splits are formed in the veneer strip V when it moves past the separating members 8 and is bent downward in contact with the lower surfaces 8*a* of the separating members 8. The veneer strips V thus produced have very little curling because of such splits.

Once the wood block 3 has become cylindrical, a continuous sheet of veneer V is produced. In response to a signal transmitted by manual operation of the lathe operator who then recognizes that peeling of a continuous veneer sheet V from the wood block 3 has begun, the control unit 51 causes the servo motor 14 (FIG. 6) to rotate the first shaft 9 for an angle of 180° without interrupting the veneer peeling operation. By so doing, the eccentric shaft 17 is turned to the position of FIG. 9 from the position of FIG. 3 and, therefore, the arm 19 supported by the eccentric shaft 17 is raised about 3 mm and hence the peripheral drive wheels 27 fixedly mounted to the shaft portion 26 are moved upward for the same distance to their raised position.

Figure 10:
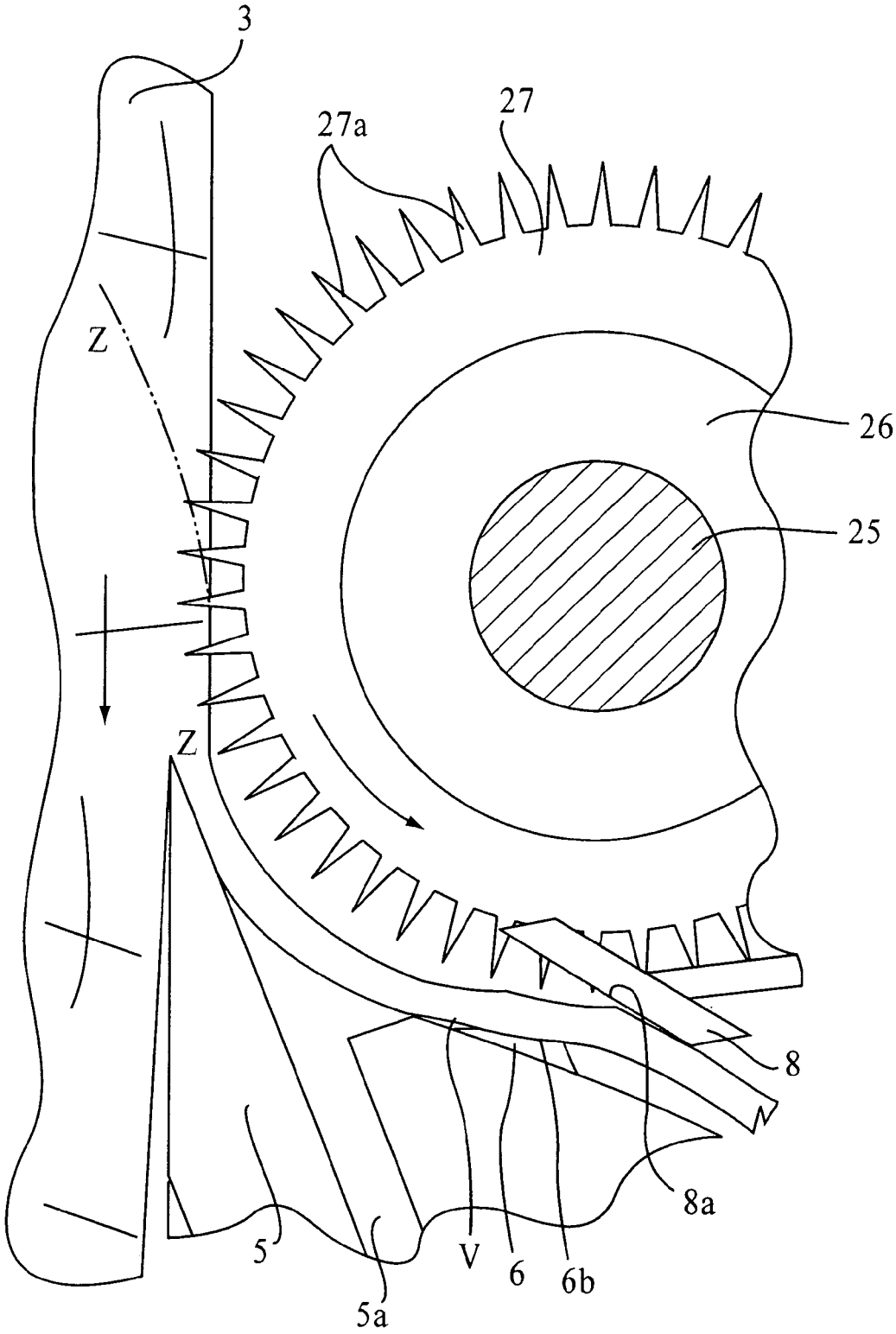
FIGS. 10 through 11 are enlarged illustrative side views showing different phases of the lathe.

As a result, the peripheral drive wheels 27 are positioned with the tip ends of their projections 27*a* spaced at a distance of about 4.5 mm from the top surface 6*b* of the guide members 6, as shown in FIG. 10. A veneer sheet V then cut from the block 3 and moving past the guide members 6 is free from engagement with the projections 27*a* of the peripheral drive wheels 27 and, therefore, the veneer sheet V is not subjected to the tensile force which produces splits. However, small splits are formed in the veneer sheet V when it moves past in contact with the surfaces 8*a* of the separating members 8. Obviously, less splits are formed in the veneer sheet V peeled in the state of FIG. 10 where the peripheral drive wheels 27 are in their raised position than in the state of FIG. 7 when the drive wheels 27 are lowered.

A continuous width of veneer sheet having reduced splits tends to be curled. Unlike veneer strips with narrow widths, veneer sheet having a continuous width poses very little problem in the subsequent processes because such veneer sheet as peed by rotary veneer lathe is usually wound or reeled into a roll by a reeling machine and the veneer sheet produced as shown in FIG. 10 is not curled to such an extent that hampers smooth reeling operation. Incidentally, the extent of split formation in the veneer sheet V can be adjusted by changing the angle of the separating members 8.

Since the diameter of the wood block 3 is reduced progressively as the veneer peeling operation is continued, the relation of the peripheral drive wheels 27 to the wood block 3 is varied. Specifically, as the block diameter is reduced to such an extent that the outer periphery of the wood block 3 is changed, for example, as indicated by chain double-dashed arcuate line Z-Z in FIG. 10, the number of projections 27*a* piercing into the peripheral surface of the wood block 3 and the overall piercing depth of the projections 27*a* are reduced, as clearly seen from FIG. 10. Therefore, the area in the wood block 3 which receives force directly from the projections 27*a* of the peripheral drive wheels 27 to drive the wood block 3 is reduced, while the force necessary for cutting veneer sheet V from the block 3 remains unchanged. Consequently, force applied to a unit area in the wood block 3 by the peripheral drive wheels 27 is increased to such an extent that circumferential grooves are formed in the peripheral surface of the block 3 by the projections 27*a* of the drive wheels 27, as a result of which the driving force from the drive wheels 27 necessary for veneer peeling is no more transmitted to the block 3.

According to the illustrated embodiment of the present invention, however, after the peripheral drive wheels 27 are moved to their raised position (FIG. 10), the servo motor 47 is operated to move the stop member 50 leftward as seen in FIG. 4 or toward the veneer knife 5 relative to the knife carriage 1 depending on the spaced distance between the axial center of the spindles 2 and the cutting edge of the veneer knife 5 which is determined by the absolute encoder 52. Accordingly, the engagement member 45 pressed against the stop member 50 by the pressure from the hydraulic cylinder 43 is moved with the stop member 50. The second connecting plate 43*b* to which the engagement member 45 is fixed is moved toward the veneer knife 5, thereby causing the arm 19 to swing about the eccentric shaft 17.

Figure 11:
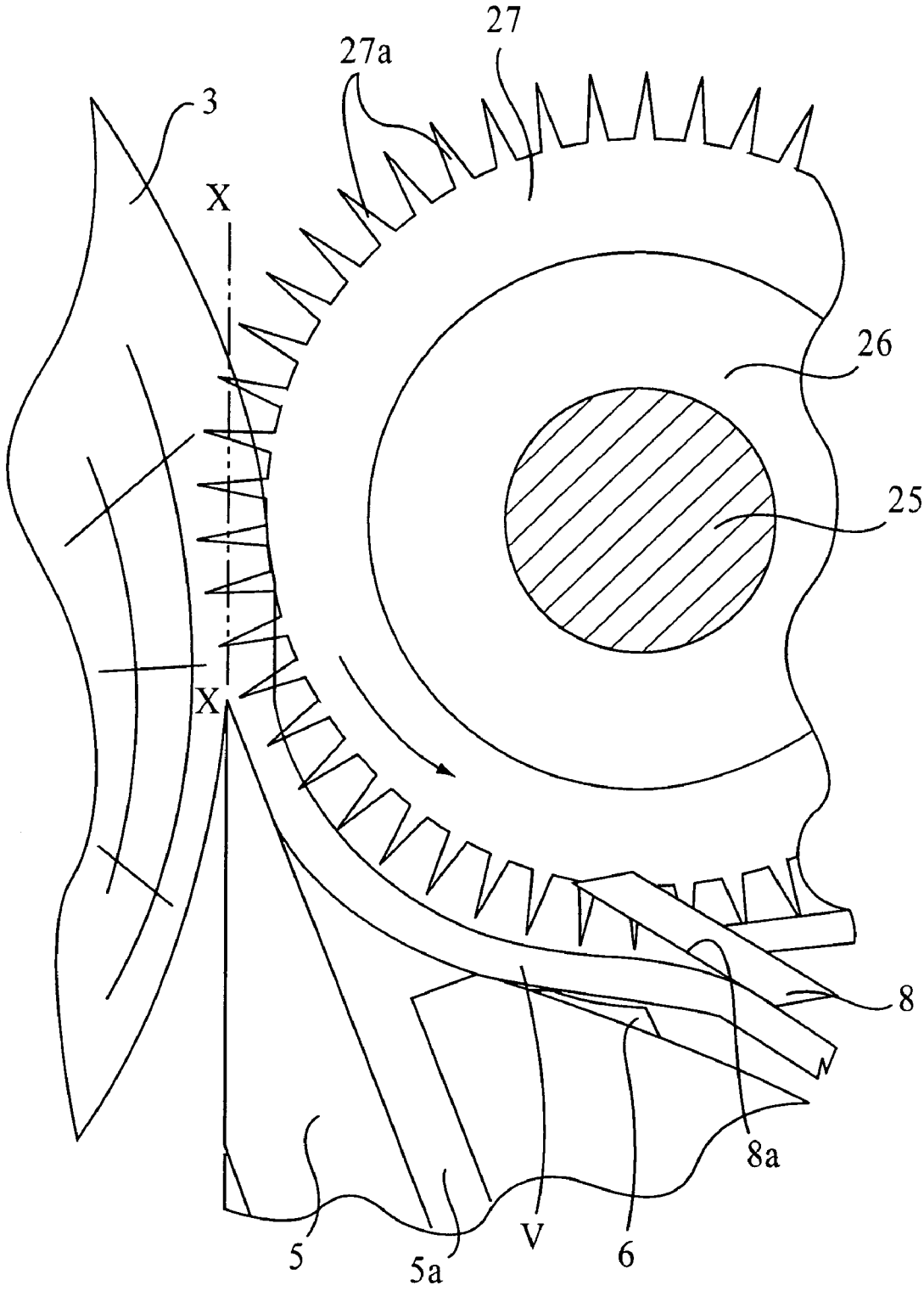

Therefore, the spiked peripheral drive wheels 27 are moved toward the wood block 3 continuously with a decrease in the above spaced distance between the axial center of the spindles 2 and the cutting edge of the veneer knife 5, with the result that the number of projections 27*a* engaging with the peripheral surface of the wood block 3 is not reduced remarkably and also that the projections 27 pierce deeper into the wood block, as shown in FIG. 11. Thus, formation of circumferential grooves in the peripheral surface of the block 3 by the projections 27*a* and the consequent failure of transmission of force to the wood block 3 from the drive wheels 27 necessary for veneer peeling can be prevented, so that veneer peeling can be performed uninterruptedly. While the drive wheels 27 are moved toward the knife 5, positional relation of the peripheral drive wheels 27 with respect to the guide members 6 in terms of the spaced distance between the tip ends of their projections 27*a* and the guide surfaces 6*b* as shown in FIG. 10 remains substantially unchanged.

The rate at which the stop member 50 is moved toward the knife 5 relative to the knife carriage 1 may be set according to the desired number of projections 27*a* to pierce into the wood block 3 and the desired piercing depth of the projections 27*a*.

When the absolute encoder 52 determines that the spaced distance between the axial center of the spindles 2 and the cutting edge of the veneer knife 5 is reduced by veneer peeling to a predetermined value, it generate a signal to the control unit 51, which then provides a control signal which causes the servo motor 53 to be stopped and then driven reverse so that the screws P are stopped and then rotated reverse, accordingly. The knife carriage 1 is moved by the servo motor 53 away from the wood block 3 until a standby position is reached which is determined by the absolute encoder 52.

After the knife carriage 1 has stopped at the standby position, the servo motor 47 is driven reverse to rotate the screw 48 for swinging the arm 19 and hence the spiked peripheral drive wheels 27 back to their retracted position as shown in FIG. 10. Subsequently, the first shaft 9 is rotated further 180° by the servo motor 14 to move the peripheral drive wheels 27 to their lowered standby position as shown in FIG. 7, thus setting the knife carriage 1 for waiting for the next cut.

As a matter of course, the peripheral drive wheels 27 must be so arranged that their tooth-like projections 27*a* will not be brought into contact with the cutting edge of the knife 5 when the drive wheels 27 are moved closest to the knife 5.

It is noted that, according to the present invention, the spiked peripheral drive wheels 27 may be moved toward the knife 5 irrespective of the spaced distance between the axial center of the spindles 2 and the cutting edge of the veneer knife 5 so that the drive wheels 27 are moved closest to the knife 5 before the above spaced distance becomes a predetermined minimum value. Alternatively, the spiked wheels 27 may be moved closest to the knife 5 immediately after the drive wheels 27 are moved to their raised position of FIG. 10. It is also noted that a change of peeling of veneer strips with narrow widths to a continuous width of veneer sheet may detected by using any suitable sensor instead of visual checking by the lathe operator.

The following will describe a second embodiment of the present invention.

The arrangement of veneer lathe for the second embodiment is substantially the same as that for the above-described first embodiment. The lathe is initially set in the same manner as in the first embodiment and the peripheral drive wheels 27 are set in their lowered position. The servo motor 2*a* is driven to rotate the spindles 2 and hence the wood block 3, and the servo motor 36 is also driven thereby to rotate the peripheral drive wheels 27. Then the servo motor 53 is operated to controllably rotate the screws P for moving the knife carriage 1 toward the wood block 3, thus veneer strips with narrow widths and a thickness of about 4 mm are produced as in the first embodiment. Such veneer strips have formed therein many large or substantial splits and, therefore, have little curling.

As the lathe operator recognizes that a continuous veneer sheet V has begun to be peeled from the wood block 3 and manually provides a signal to the control unit 51, the servo motor 14 is driven thereby to rotate the first shaft 9 for an angle of 180°. Accordingly, the eccentric shaft 17 is turned to the position of FIG. 9 and the arm 19 supported by the eccentric shaft 17 is raised about 3 mm, so that the peripheral drive wheels 27 are positioned with the tip ends of their projections 27*a* spaced at a distance of about 4.5 mm from the top surface 6*b* of the guide members 6, as shown in FIG. 10. Thus, a veneer sheet V with little splits is produced as in the first embodiment.

Figure 12:
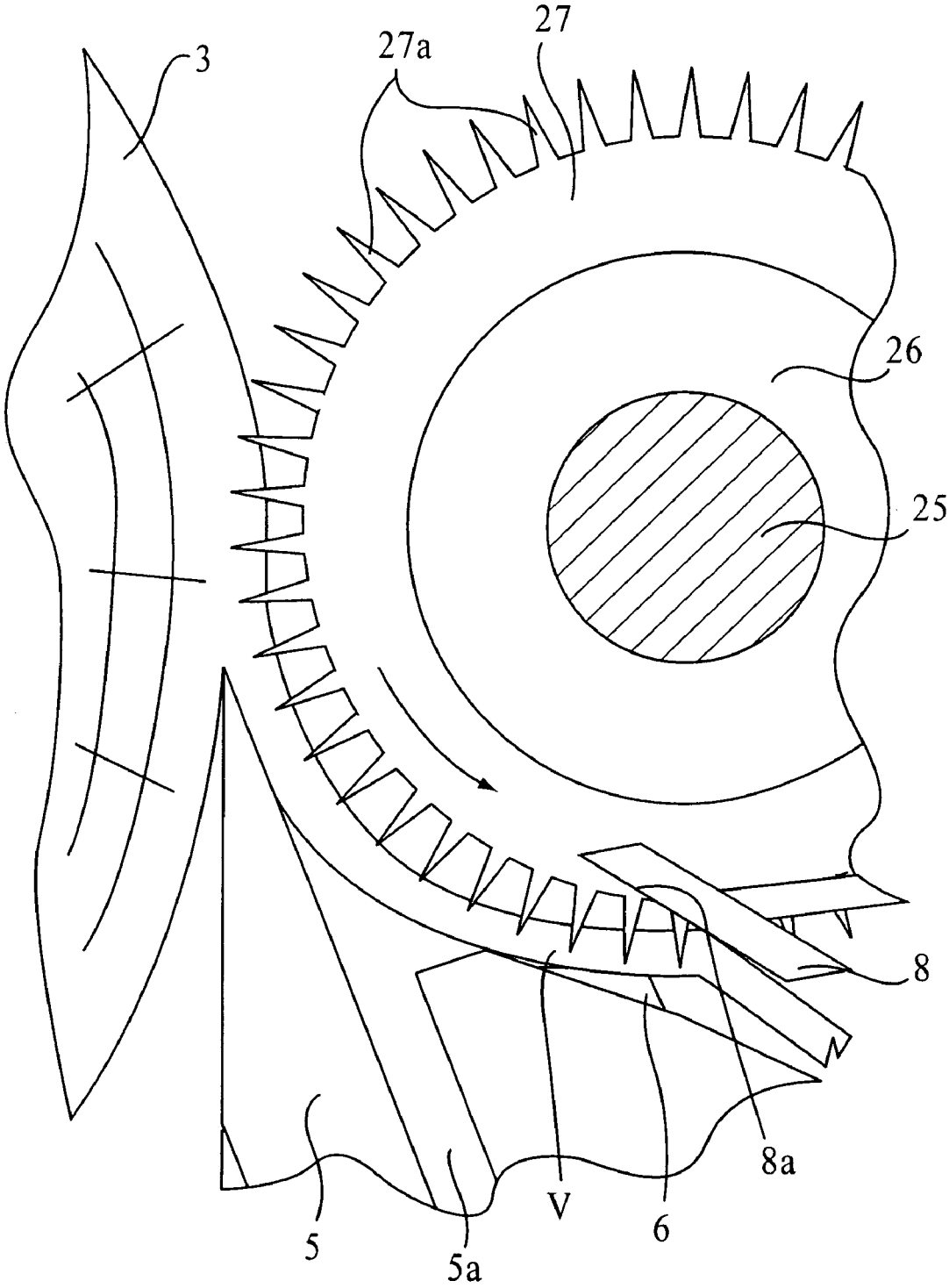
FIG. 12 is an enlarged illustrative side view in a second preferred embodiment of the invention.

According to this second embodiment, when the spaced distance between the axial center of the spindles 2 and the cutting edge of the knife 5 is reduced to a preset value which is determined by the absolute encoder 52, the servo motor 14 is operated to turn the first shaft 9 for further 180° thereby to move the spiked peripheral drive wheels 27 to their lowered position. By so doing, the relation of the peripheral drive wheels 27 to the wood block 3 becomes as shown in FIG. 12. Though the number of projections 27*a* piercing into the peripheral surface of the wood block 3 and the overall piercing depth of the projections 27*a* in the position of the peripheral drive wheels 27 in FIG. 12 are less as compared with the position in FIG. 11 in the first embodiment, the number and the depth are both increased in comparison with the case when the wood block diameter is reduced as shown by the block circular arc indicated by chain double-dashed line Z-Z in FIG. 10 in which the peripheral drive wheels 27 are in their raised position.

Thus, formation of the above-described circumferential grooves by the tooth-like projections 27*a* of the peripheral drive wheels 27 is prevented and, therefore, the force from the drive wheels 27 necessary for veneer peeling continues to be transmitted to the block 3 for smooth veneer peeling operation.

Veneer sheet produced with the peripheral drive wheels 27 placed in their lowered position as shown in FIG. 12 will have formed therein many large or substantial splits. However, such veneer sheet may be used for core stock or inner plies of glued laminated wood such as plywood.

The following will describe a third embodiment of the present invention.

As in the cases of the above first and second embodiments, the peripheral drive wheels 27 are initially placed in their lowered position of FIG. 7 and, when a continuous veneer sheet V begins to be peeled from the wood block 3, the peripheral drive wheels 27 are moved to their raised position of FIG. 10. When the spaced distance between the axial center of the spindles 2 and the cutting edge of the knife 5 is reduced during peeling of veneer sheet V to a preset value, the servo motor 14 is operated to turn the first shaft 9 further 180° thereby to move the peripheral drive wheels 27 to their lowered position, as in the above second embodiment.

Figure 13:
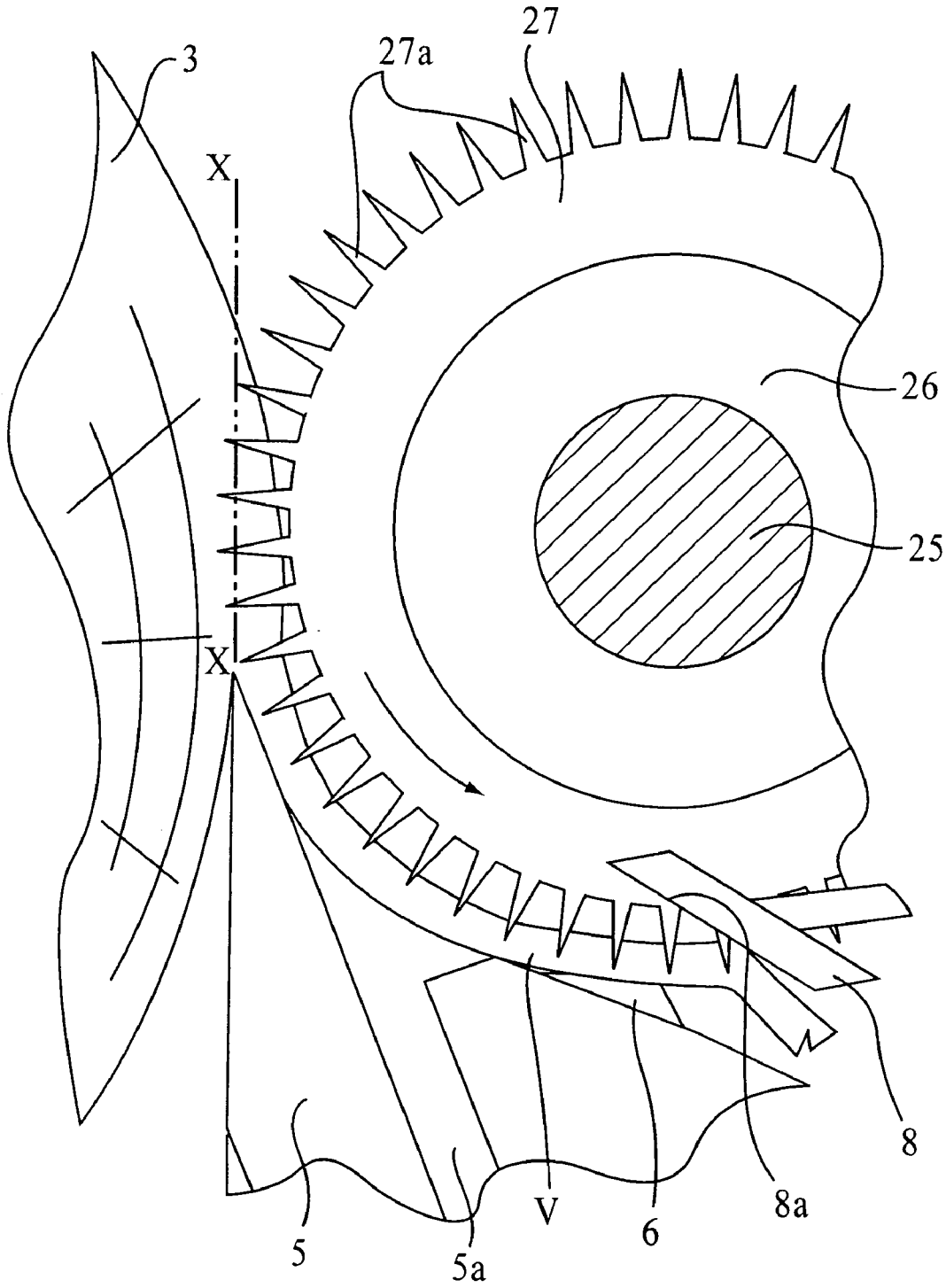
FIG. 13 is an enlarged illustrative side view in a third preferred embodiment of the invention.

According to the third embodiment, the servo motor 47 is then operated to move the stop member 50 toward the veneer knife 5 relative to the knife carriage 1 depending on the spaced distance between the axial center of the spindles 2 and the cutting edge of the veneer knife 5 which is determined by the absolute encoder 52. As a result, the arm 19 is swung about the shaft 17 thereby to move the spiked peripheral drive wheels 27 toward the wood block 3 continuously with a decrease in the above spaced distance between the axial center of the spindles 2 and the cutting edge of the veneer knife 5, as in the first embodiment, so that, as compared with the case of the second embodiment of FIG. 12, the number of projections 27*a* piercing into the peripheral surface of the wood block 3 and the overall piercing depth of the projections 27*a* are both increased as shown in FIG. 13. Thus, the peripheral driving force of the drive wheels 27 is transmitted to the wood block 3 without a failure due to the circumferential grooving in the peripheral surface of the block 3 by the projections 27*a* of the drive wheels 27 and, therefore, veneer peeling can be performed uninterruptedly.

As in the first embodiment, the rate at which the stop member 50 is moved toward the knife 5 relative to the knife carriage 1 may be set according to the desired number of projections 27*a* to pierce into the wood block 3 and the desired piercing depth of the projections 27*a*, and the peripheral drive wheels 27 must be so arranged that their tooth-like projections 27*a* will not be brought into contact with the cutting edge of the knife 5 when the drive wheels 27 are moved as far as they can.

The following will describe a fourth embodiment of the present invention. This embodiment is advantageously applicable in peeling veneer from a substantially cylindrical block which is previously rounded by a rotary veneer lathe or any cutter or from a block having a small diameter of about 200 mm.

The arrangement of veneer lathe for the fourth embodiment is substantially the same as that for the first embodiment. Unlike the first and second embodiments, the peripheral drive wheels 27 are initially set in their raised position. In operation, the knife carriage 1 is moved toward a rotating wood block 3 at a desired feedrate, and the peripheral drive wheels 27 are moved relative to the knife carriage 1 toward the wood block 3 according to the information from the absolute encoder 52 that is indicative of the current spaced distance between the axial center of the spindles 2 and the cutting edge of the knife 5, as in the first embodiment.

A veneer sheet cut according to the method of this fourth embodiment and moving past the guide members 6 is not subjected to tensile force by the projections 27*a* of the drive wheels 27 which causes substantial splits in the veneer sheet. Thus, the veneer sheet is formed only with little splits. Only small splits are formed in the veneer sheet V when it moves past in contact with the surfaces 8*a* of the separating members 8.

When a cylindrical wood block is rotary cut by a veneer lath, a continuous sheet of veneer is produced from the beginning of veneer peeling and such veneer sheet is reeled into a roll by a reeling machine, as described earlier with reference to the first embodiment.

Veneer strips with narrow widths peeled from a non-cylindrical wood block with a smaller diameter tend to be curled in such a way that the surface of veneer strip on the side that is adjacent to the peripheral drive wheels 27 when it is just cut by the knife lies outside of the curl. This is due to a greater difference in length between the above side of veneer strip and the opposite side thereof of a veneer strip cut from a wood block with a smaller diameter. Therefore, the curling developed by splits formed during veneer peeling is offset by the above tendency of curling, so that veneer strips with narrow widths peeled from a wood block having a small diameter of about 200 mm has little curling.

As an alternative of this fourth embodiment, the servo motor 14 may be operated to turn the first shaft 9 for 180° thereby to move the peripheral drive wheels 27 to their lowered position when the wood block 3 is further cut to a predetermined diameter. By so moving the drive wheels 27, the relation of the drive wheels 27 to the wood block 3 becomes as shown in FIG. 12. As described earlier with reference to the second embodiment, formation of circumferential grooves by the tooth-like projections 27*a* of the peripheral drive wheels 27 is prevented, so that the force from the drive wheels 27 necessary for veneer peeling continues to be transmitted to the block 3 and uninterrupted veneer peeling operation is accomplished.

As a further alternative embodiment, after the peripheral drive wheels 27 are lowered, the servo motor 47 may be operated to move the stop member 50 toward the veneer knife 5 according to the information from the absolute encoder 52 so that the peripheral drive wheels 27 are moved relative to the knife carriage 1 toward the wood block 3 continuously with a further decrease in the block diameter.

Although the foregoing has described the present invention by way of specific embodiments, it is to be understood that the present invention is not limited to those embodiments, but the invention can be practiced in various changes and modifications, as exemplified below.

Figure 15:
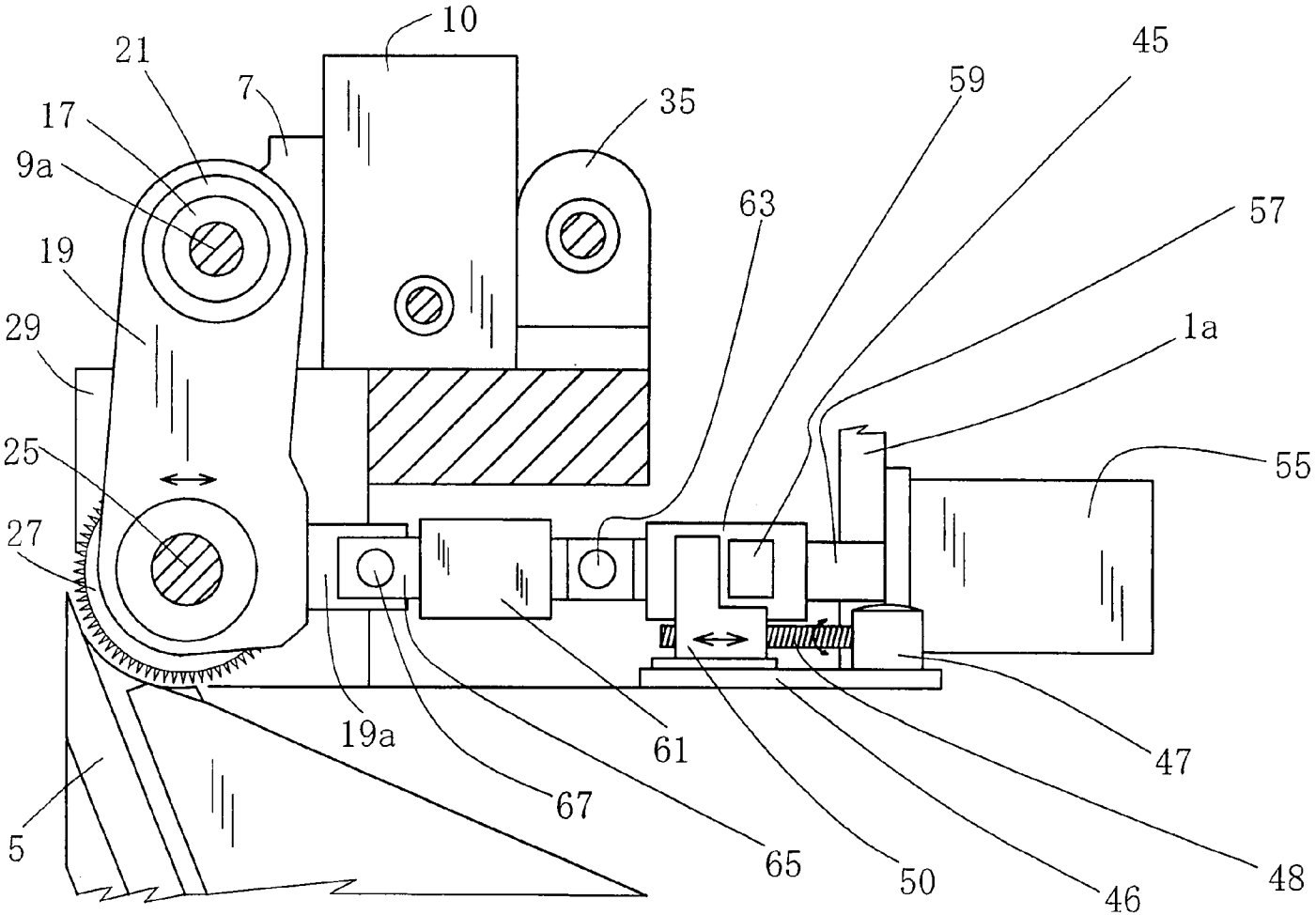
FIG. 15 is a partially sectional side view similar to FIG. 4, but showing a modified embodiment of the present invention.

Referring to FIG. 15 showing a modified embodiment of the present invention, a hydraulic cylinder 55 having a piston rod 57 is fixedly mounted on part of the nose bar block 1*a*. The distal end of the piston rod 57 is connected to one end of a connecting plate 59, the other end of which is connected by a pin 63 to an air cylinder 61. The air cylinder 61 has a piston rod 65 which is connected by a pin 67 to the connecting plate 19*a*. Though not shown in the drawing, the bottom surface of the connecting plate 59 is slidably supported by a part of the nose bar block 1*a*. The engagement member 45 is fixedly mounted to the connecting plate 59 in the same manner as in the first embodiment (FIG. 4). Support block 46, servo motor 47, screw 48, linear bearing 49, stop member 50 and other parts and devices are arranged also in the same manner as in the first embodiment shown in FIG. 4.

According to the embodiment of FIG. 15, veneer peeling is initiated with the spiked peripheral drive wheels 27 set in their lowered position, and the peripheral drive wheels 27 are moved to their raised position when a signal is transmitted by manual operation of the lathe operator who recognizes that peeling of a continuous veneer sheet V from the wood block 3 has begun, as in the first embodiment. After the peripheral drive wheels 27 are moved to their raised position, the servo motor 47 is operated to move the stop member 50 leftward as seen in FIG. 15 depending on the spaced distance between the axial center of the spindles 2 and the cutting edge of the veneer knife 5 which is determined by the absolute encoder 52, also as in the first embodiment.

In the first embodiment, if any wood piece or debris is held and moved past between the wood block 3 and the peripheral drive wheels 27 during peeling operation, the presence of such wood piece creates a force against both the peripheral drive wheels 27 and the wood block 3, which force may cause the block 3 to be broken or some of the tooth-like projections 27*a* of the peripheral drive wheels 27 or any member supporting such drive wheels 27 to be damaged. In the modified embodiment of FIG. 15 wherein air cylinder 61 is interposed between the connecting plates 59 and 19*a*, the harmful force is transmitted via the drive wheels 27 to the piston rod 65, which is then pushed into the air cylinder 61. Thus, the peripheral drive wheels 27 connected to the piston rod 65 of the air cylinder 61 through the connecting plate 19*a* can move away from the wood block 3 when any wood piece is held between the wood block 3 and the peripheral drive wheels 27 and, therefore, no damaging force acts on the peripheral drive wheels 27 and the wood block 3.

Figure 14:
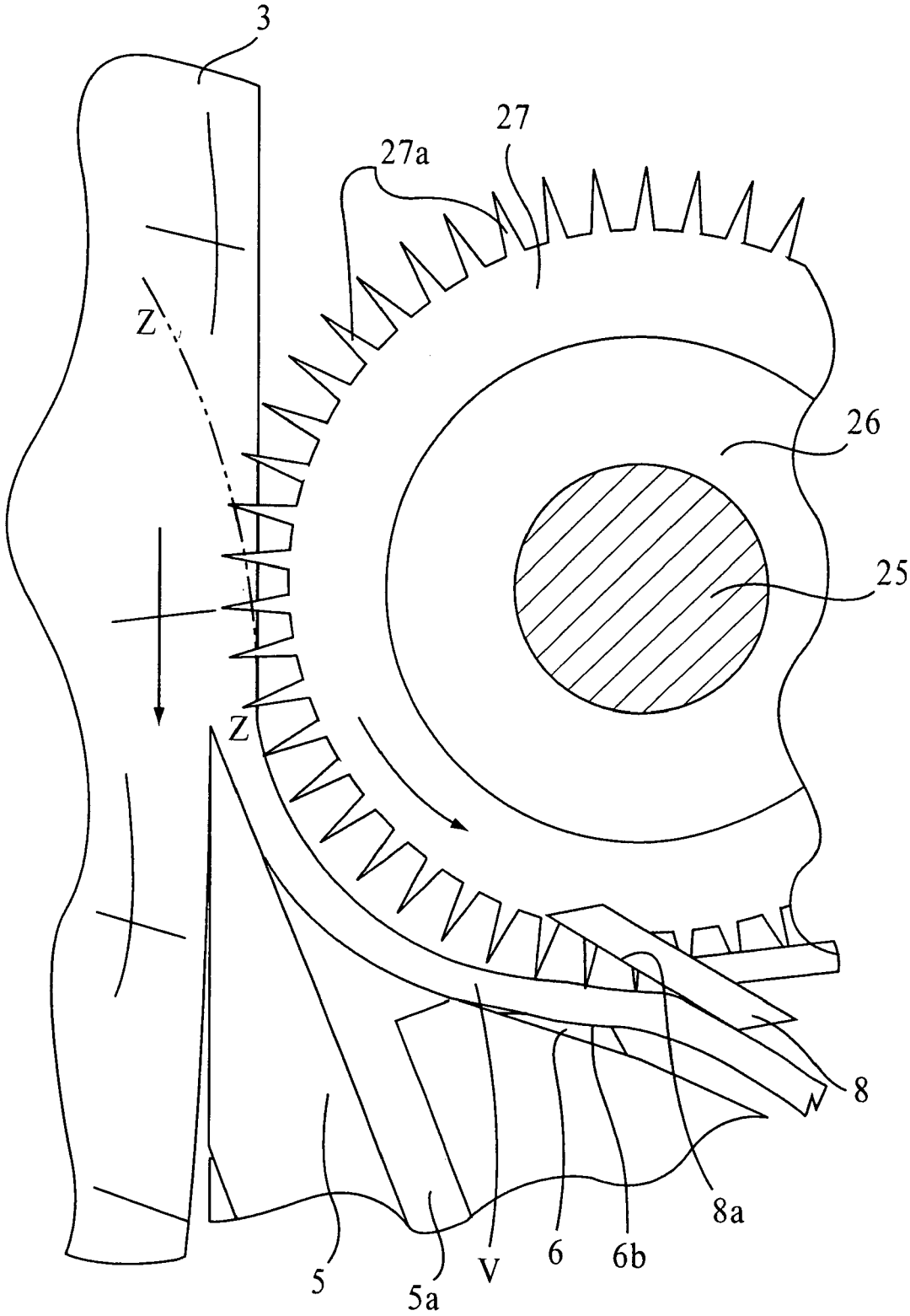
FIG. 14 is an enlarged illustrative side view in a modified embodiment of the invention.

In each of the foregoing embodiments, the spiked peripheral drive wheels 27 in their lowered position may be moved to a raised position as shown in FIG. 14 by rotating the shaft 9 for an angle that is less than 180°, where the projections 27*a* of the peripheral drive wheels 27 piece just slightly into the veneer V moving past the guide members 6. By so positioning the drive wheels 27, the veneer V is assisted in smoothly moving past the guide member 6 and any wood piece or debris adjacent to the guide members 6 can be discharged therefrom by the projections 27*a* which pierce slightly in the veneer V. For these purposes, the piercing depth of the projections 27*a* in to the veneer V should be only to such an extent that no substantial splits are formed in the veneer V, e.g. a depth of about 1 mm for 4 mm thick veneer. Though minute splits may be formed in the veneer V by the projections 27*a* when the veneer V moves past the guide members 6 and the separating members 8, these are not substantial splits which weaken or break the veneer V thereby to affect the veneer quality or overall veneer yield. Desired piercing depth by which no substantial splits are formed in veneer may be selected through test peeling veneer with various piercing depths.

When shifting the spiked peripheral drive wheels 27 between the raised and lowered positions thereof, the feedrate of the knife carriage 1 or the distance the knife 5 cuts into a rotating wood block 3 for each complete turn of the block 3 may be changed so that veneer with a different thickness is peeled after the shifting of the peripheral drive wheels position. Additionally, veneer peeling operation does not necessarily have to be performed uninterruptedly, but the knife carriage 1 may be stopped thereby to interrupt the peeling operation when changing the position of the peripheral drive wheels 27 between the raised and lowered positions thereof.

In the aforementioned first and third embodiments, the peripheral drive wheels 27 may be moved relative to the knife carriage 1 toward the wood block 3 by the hydraulic cylinder 43 irrespective of the reduction of wood block diameter. For example, the drive wheels 27 may be moved at once as far as it will go within its predetermined stroke toward wood block 3.

The mechanism for moving the spiked peripheral drive wheels 27 relative to the knife carriage toward and away from the wood block 3, which includes hydraulic cylinder 43, engagement member 45, stop member 50, servo motor 47 and other parts and devices, may includes a plurality of such mechanism units which are arranged at a spaced interval along the shaft portion 25 and operable simultaneously.

In the above-described embodiments, a pair of first and second backup rolls 71 and 73 may be used for supporting a wood block 3 and also preventing deflection thereof. The first roll 71 extends along the axial direction of the wood block 3 and disposed on the opposite side of the wood block 3 to the peripheral drive wheels 27. The roll 71 is movable horizontally radially, as shown by arrow, in rotational contact with the peripheral surface of the block 3 according to a control signal from the control unit 51 which receives information from the absolute encoder 52 while the block 3 is reduced in diameter by continued veneer peeling. On the other hand, the second backup roll 73 which also extends axially of the wood block 3 and is disposed at the bottom of the block 3 is movable vertically radially, as shown by arrow, while keeping rotational contact with the periphery of the wood block 3 while it is reduced in diameter.

In the rotary veneer lathe equipped with such backup rolls 71, 73, the spaced distance between the axial center of the spindles 2 and the cutting edge of the knife 5 is reduced to a predetermined value after a continuous veneer sheet has begun to be peeled from the wood block 3, the spindles 2 are retracted or moved away from the opposite ends of the wood block 3 so that the block 3 is supported only by the backup rolls 71, 73 and the peripheral drive wheels 27. As is obvious to those skilled in the art, the use of such backup rolls 71, 73 makes possible cutting a wood block down to a core diameter that is smaller than that of the spindles 2, with the result that the overall veneer yield is further increased.

If the peripheral drive wheels 27 are moved from the lowered position to the raised position while the wood block 3 is supported by the backup rolls 71, 73 and the drive wheels 27, the block 3 is also moved upward and failure in veneer peeling occurs. To prevent such situation, the block 3 should be supported by the spindles 2 when moving the peripheral drive wheels 27 upward, and the spindles 2 may be retracted from the block 3 when the movement of the drive wheels 27 is completed.

As means for supporting the wood block 3 other than the spindles 2, a plurality of rolls, at least one of which is positively driven, may be arranged round and in contact with the peripheral surface of the block 3.

In the middle of cutting a wood block for veneer peeling with the peripheral drive wheels 27 placed in either of the lowered or raised position or with the drive wheels 27 being moved relative to the knife carriage 1 toward the wood block 3, the feedrate of the knife carriage 1 and hence the thickness of veneer to be peeled may be changed by appropriate manual operation of the lathe operator.

The spiked peripheral drive wheel 27 may be designed according to any specific requirements. For example, the shape of the tooth-like projections 27*a* and the circumferential spaced distance between any two projections 27*a* may be changed as required. The number of peripheral drive wheels 27 on the shaft 26 and the spaced distance of such drive wheels 27 in the axial direction of the shaft 26 may be changed according to any specific requirement.

The eccentric shaft 17 or the hydraulic cylinder 43 for moving the peripheral drive wheels 27 may be replaced by any suitable means such as cam.

Though the guide member 6 of the foregoing embodiments is disposed between any two adjacent peripheral drive wheels 27, each guide member 6 may be arranged in a directly facing relation to a peripheral drive wheel 27.

For the veneer V moving past the guide members 6 to be free from the influence of tensile force by the projections 27 of the peripheral drive wheels 27, the spaced distance between the tip ends of the projections 27*a* and the top surfaces 6*a* of the guide members 6 should be greater than the thickness of veneer to be peeled. For the veneer V to move past the guide members 6 smoothly, however, the above spaced distance may be reduced to such an extent that the projections 27*a* pierce about 0.5 mm into the veneer V. Tensile force created by this extent of piercing of the projections 27*a* does not cause substantial splits in the veneer V.

Figure 16:
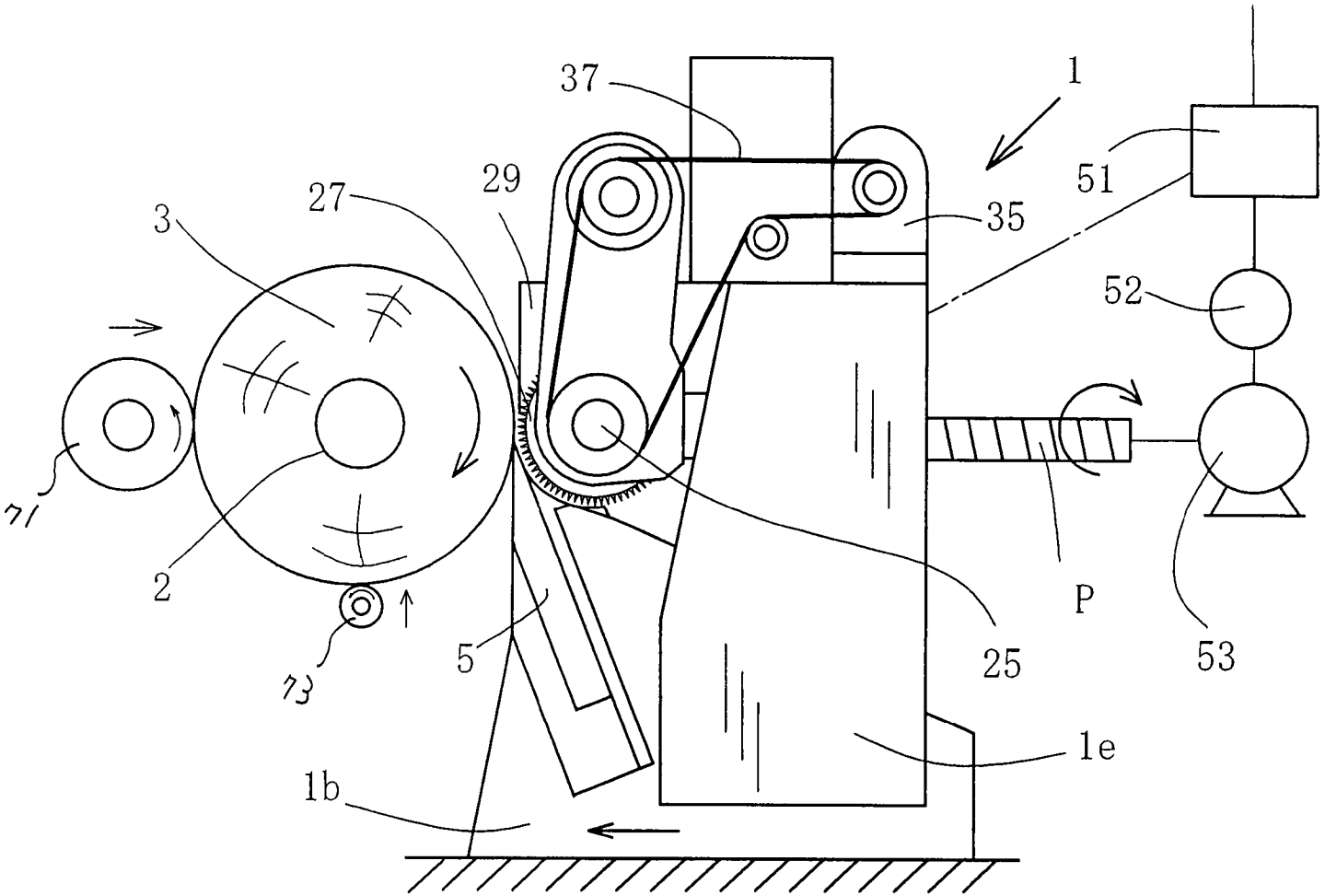
FIG. 16 is a schematic side view similar to FIG. 1, but showing a modified embodiment of the present invention.
Figure 17:
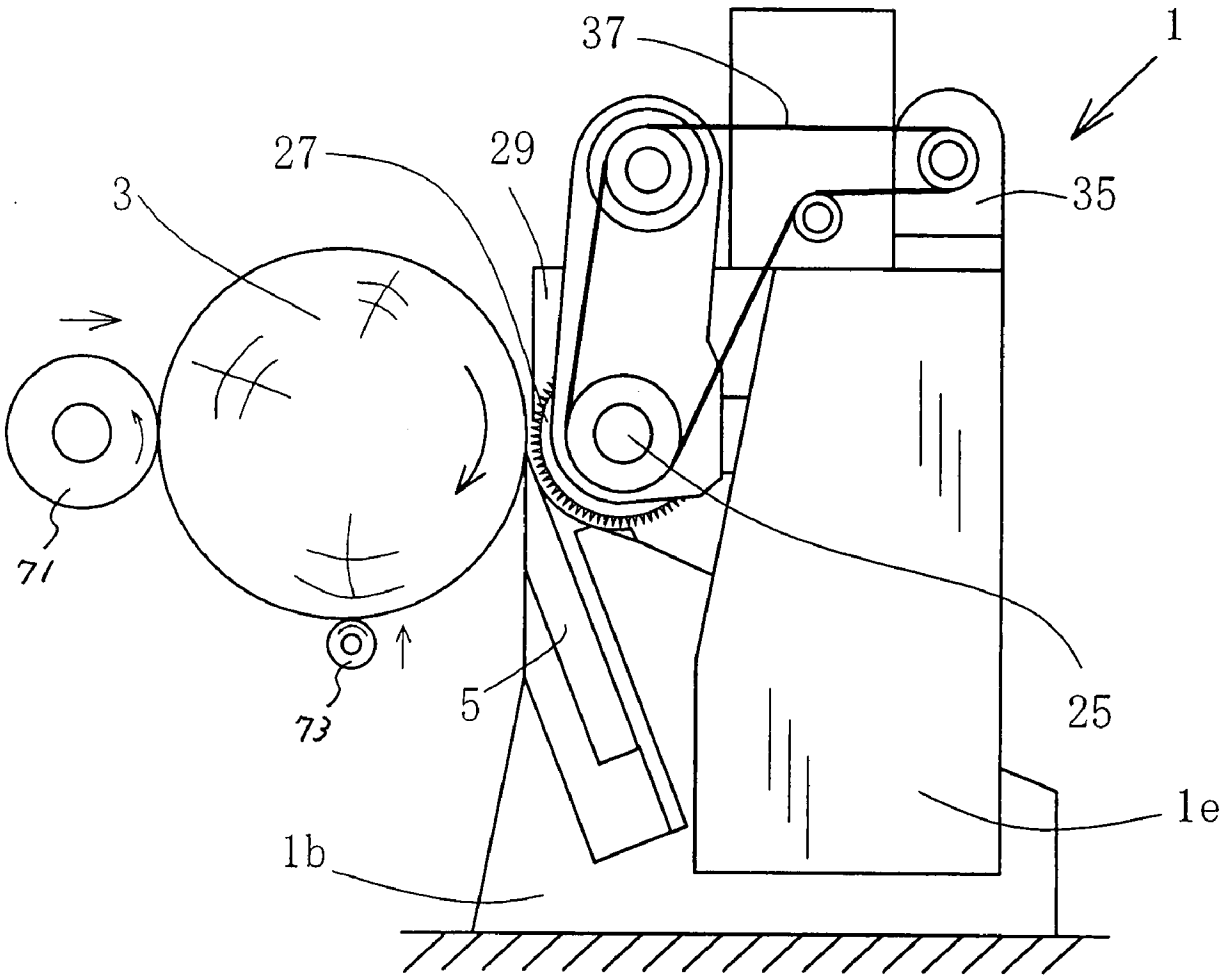
FIG. 17 is a schematic side view showing still another embodiment of the present invention.

A rotary veneer lathe shown in FIG. 17 and constructed according to the present invention differs from the lathe shown in FIGS. 1 and 16 in that the knife carriage 1 is stationary. The backup rolls 71, 73 are movable in conjunction with the reduction in diameter of the wood block 3. This type of veneer lathe is applicable in peeling veneer from a substantially cylindrical block 3 from the beginning. In operation of this veneer lathe, with the peripheral drive wheels 27 and the backup rolls 71, 73 engaged with the block 3 as shown in FIG. 17, the drive wheel 27 are rotated to drive the wood block 3 for rotation in arrow direction and the wood block 3 is moved toward the knife carriage 1. During veneer peeling operation, the backup rolls 71, 73 are moved toward the axial center of the block 3 for a distance corresponding to twice the thickness of veneer to be peeled for each complete turn of the block 3.

What is claimed is:

1. A method of cutting a wood block for production of veneer by a rotary veneer lathe equipped with a knife carriage and a support for rotatably supporting the wood block, said knife carriage having a veneer peeling knife having a cutting edge, a number of rotatable peripheral drive wheels disposed at a spaced interval in parallel relation to said cutting edge of the veneer knife and each having on the circumferential periphery a number of tooth-like projections pierceable into peripheral surface of the wood block adjacent to the cutting edge of the veneer knife for driving the wood block from the periphery thereof for rotation about its axis, said peripheral drive wheels being movable relative to said knife carriage, a first drive for rotating said peripheral drive wheels, a second drive for moving said peripheral drive wheels relative to said knife carriage, a pressure member disposed adjacent to the peripheral drive wheel for pressing against the peripheral surface of the wood block, a guide member disposed adjacent to the peripheral drive wheel for guiding veneer peeled from the wood block along the peripheral drive wheels, and a separating member disposed downstream of said guide member with respect to the direction of rotation of said peripheral drive wheels for separating the veneer from the peripheral drive wheels, either one of said knife carriage and the wood block being moved toward the other such that said veneer knife on the knife carriage cuts into the peripheral surface of rotating wood block for peeling veneer therefrom, said method comprising:

cutting the wood block with the peripheral drive wheels placed at a position where the projections of the peripheral drive wheels pierce the peripheral surface of the wood block adjacent to the cutting edge of the veneer knife and the projections of the peripheral drive wheels provide no such force to the veneer peeled from the wood block and moving past said guide member that causes the substantial splits in the veneer along wood grain thereof.

2. A method of cutting a wood block for production of veneer by a rotary veneer lathe according to claim 1, wherein said cutting of the wood block with the peripheral drive wheels placed at said position includes moving the peripheral drive wheels relative to said knife carriage for a predetermined distance toward the wood block.

3. A method of cutting a wood block for production of veneer by a rotary veneer lathe according to claim 1, wherein said knife carriage is movable toward the wood block.

* * * * *